US010449772B2

(12) United States Patent
Nagashima et al.

(10) Patent No.: US 10,449,772 B2
(45) Date of Patent: Oct. 22, 2019

(54) CARTRIDGE AND LIQUID EJECTION SYSTEM

(71) Applicant: Seiko Epson Corporation, Tokyo (JP)

(72) Inventors: Takumi Nagashima, Matsumoto (JP); Hiroyoshi Ozeki, Shiojiri (JP); Hiroyuki Kawate, Hokuto (JP); Atsushi Kobayashi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/892,115

(22) Filed: Feb. 8, 2018

(65) Prior Publication Data

US 2018/0272727 A1 Sep. 27, 2018

(30) Foreign Application Priority Data

Mar. 24, 2017 (JP) ..... 2017-058948

(51) Int. Cl.
*B41J 2/175* (2006.01)
*B41J 29/13* (2006.01)

(52) U.S. Cl.
CPC ..... *B41J 2/17523* (2013.01); *B41J 2/175* (2013.01); *B41J 2/1752* (2013.01); *B41J 2/1753* (2013.01); *B41J 2/17509* (2013.01); *B41J 2/17513* (2013.01); *B41J 2/17526* (2013.01); *B41J 2/17556* (2013.01); *B41J 29/13* (2013.01); *B41J 2002/17516* (2013.01)

(58) Field of Classification Search
CPC ..... B41J 2/17523; B41J 2/17509; B41J 2/17513; B41J 29/13; B41J 2/1753; B41J 2/1752; B41J 2/175; B41J 2/17556; B41J 2/17526; B41J 2002/17516
See application file for complete search history.

(56) References Cited

U.S. PATENT DOCUMENTS

| | | | |
|---|---|---|---|
| 7,018,027 | B2 | 3/2006 | Harada et al. |
| 7,293,864 | B2 | 11/2007 | Kimura et al. |
| 7,438,401 | B2 | 10/2008 | Seino et al. |
| 7,806,523 | B2 | 10/2010 | Seino et al. |

(Continued)

FOREIGN PATENT DOCUMENTS

| | | | |
|---|---|---|---|
| JP | 2005-059317 | A | 3/2005 |
| JP | 2009-279876 | A | 12/2009 |

(Continued)

OTHER PUBLICATIONS

IP.com search (Year: 2019).*

*Primary Examiner* — Lisa Solomon
(74) *Attorney, Agent, or Firm* — Foley & Lardner LLP

(57) ABSTRACT

A cartridge includes: a case; an accommodation part inside of the case; a liquid leading-out port; a cartridge side electrical connection part; and a cartridge side fixation structure. Engagement of the device side fixation structure and the cartridge side fixation structure restricts moving the case in a state of being imparted with the force directing to −Z direction. The cartridge side fixation structure and the cartridge side electrical connection part overlap with each other at least in a part when the cartridge is viewed in Z directions. A width of the cartridge in the Z direction is smaller than a width in Y direction and a width in the X directions.

13 Claims, 22 Drawing Sheets

(56) References Cited

U.S. PATENT DOCUMENTS

| | | | |
|---|---|---|---|
| 7,954,935 | B2 | 6/2011 | Kimura et al. |
| 8,220,909 | B2 | 7/2012 | Domae |
| 8,646,889 | B2 | 2/2014 | Aoki et al. |
| 8,931,887 | B2 | 1/2015 | Aoki et al. |
| 8,955,951 | B2 | 2/2015 | Aoki et al. |
| 8,960,871 | B2 | 2/2015 | Karasawa et al. |
| 9,004,659 | B2 | 4/2015 | Aoki et al. |
| 9,108,417 | B2 | 8/2015 | Aoki et al. |
| 9,139,013 | B2 | 9/2015 | Nagashima et al. |
| 9,266,337 | B2 | 2/2016 | Aoki et al. |
| 9,440,755 | B2 | 9/2016 | Aoki et al. |
| 2005/0036015 | A1 | 2/2005 | Seino et al. |
| 2005/0052511 | A1 | 3/2005 | Seino et al. |
| 2015/0077483 | A1* | 3/2015 | Nagashima ..... B41J 2/17523 347/86 |
| 2016/0031224 | A1 | 2/2016 | Aoki et al. |
| 2017/0057236 | A1 | 3/2017 | Hatano et al. |

FOREIGN PATENT DOCUMENTS

| | | | |
|---|---|---|---|
| JP | 2014-240182 | A | 12/2014 |
| JP | 5980391 | B1 | 8/2016 |
| WO | WO-2013/105504 | A1 | 7/2013 |

* cited by examiner

CARTRIDGE AND LIQUID EJECTION SYSTEM

CROSS REFERENCE TO RELATED APPLICATION

The present application claims the priority based on Japanese Patent Application No. 2017-058948 filed on Mar. 24, 2017, and the entire disclosure of which is incorporated herein by reference.

BACKGROUND

Field

The present disclosure relates to a cartridge and a liquid ejection system.

Related Art

As an aspect of a liquid ejection device, an inkjet printer (hereinafter, also referred to as, simply, a "printer") that ejects ink being liquid toward a medium being a printing object, is known. The printer is generally mounted with a cartridge that accommodates the ink, in an exchangeable manner (for example, International Patent Application Publication No. WO2013/105504 pamphlet, Japanese Patent Application Publication No. 2014-240182, and Japanese Patent Application Publication No. 2005-59317). In the printer, when the cartridge is mounted, an ink supplying path and an electrical communication path are established between the printer and the cartridge.

It is desirable that the cartridge is mounted to the printer in a suitable posture that is predetermined. When the mounting posture is not suitable, the ink supplying path and the electrical communication path of the printer may not be established. There is also a risk that the connection state of the ink supplying path and the electrical communication path becomes unstable and the connection state would be worsened as time passes. In addition, when the cartridge is connected to the printer, excessive stress may be generated by contact with a component of the printer side and damage or degradation may be generated. Conventionally, research has been conducted for improvement of the mounting posture of the cartridge with respect to the printer. However, room for improvement is still left. Such problem is not limited to a cartridge for a printer, and is a common problem in a cartridge mounted in a liquid ejection device, and a liquid ejection system including a cartridge and a liquid ejection device.

SUMMARY

The present disclosure has been performed for solving at least a part of the problem described above and may be realized as aspects described below.

(1) According to a first aspect of the present disclosure, a cartridge mounted to a liquid ejection device is provided. It is defined that parallel directions to a gravity direction are Z directions, the same direction as the gravity direction among the Z directions is +Z direction, an opposite direction from the gravity direction among the Z directions is −Z direction, orthogonal directions to the Z directions are Y directions, one direction of the Y directions is +Y direction, the other direction of the Y directions is −Y direction, orthogonal direction to the Z directions and the Y directions are X directions, one direction of the X directions is +X direction, and the other direction of the X directions is −X direction.

The liquid ejection device includes: a housing provided with a cartridge accommodation part in the inside; a device side fixation structure that extends from an end portion of the +Y direction side of the cartridge accommodation part in the −Y direction; a liquid leading-in part located in the end portion of the +Y direction side of the cartridge accommodation part; and a device side electrical connection part located in the end portion of the +Y direction side of the cartridge accommodation part.

The cartridge includes: a case configured to be inserted to the cartridge accommodation part by moving along the +Y direction; an accommodation part provided in the inside of the case and configured to accommodate liquid; a liquid leading-out port configured to accept the liquid leading-in part in a mounting state where the cartridge is mounted to the liquid ejection device; a cartridge side electrical connection part configured to electrically contact with the device side electrical connection part while receiving a force having a component of at least the +Z direction, from the device side electrical connection part in the mounting state; and a cartridge side fixation structure configured to engage with the device side fixation structure in the mounting state. The case is restricted moving in the −Y direction in a state of being imparted with the force directing in the −Z direction by engagement of the device side fixation structure and the cartridge side fixation structure in the mounting state. The cartridge side fixation structure and the cartridge side electrical connection part are provided at positions overlapping with each other at least in a part when the cartridge in a posture of the mounting state is viewed in the Z directions. In the posture of the mounting state, a width of the cartridge in the Z directions is smaller than a width in the Y directions and a width in the X directions.

According to the cartridge of this aspect, at least a part of the force of the +Z direction received by the cartridge side electrical connection part from the device side electrical connection part is reduced by the force of the −Z direction imparted to the cartridge side fixation structure by the device side fixation structure for forming an engagement state of the case. Accordingly, the component of the force in the Z directions imparted to the cartridge is reduced, the arrangement posture of the cartridge is prevented from shifting from a proper posture to the Z directions, and the connection state of the cartridge with respect to the liquid ejection device is improved. Further, an unnecessary stress is prevented from generating at a connection portion between the liquid ejection device and the cartridge due to deterioration of the arrangement posture of the cartridge. Thus, the connection portion is prevented from being damaged or degraded. According to the cartridge of this aspect, the width in the Z directions is smaller than the width in the X directions and Y directions, in the posture of the mounting state. Thus, the arrangement posture of the cartridge in the liquid ejection device is further stabilized. Therefore, the connection state of the cartridge with respect to the liquid ejection device is further improved.

(2) In the cartridge described above, the cartridge side electrical connection part has a contact surface that contacts with the device side electrical connection part in the mounting state. A normal vector of the contact surface may have a vector component of the −Z direction and a vector component of the +Y direction when the cartridge is in the posture of the mounting state.

According to the cartridge of this aspect, the electrical connection state between the cartridge side electrical connection part and the device side electrical connection part can be formed by utilizing a force of the case moving in the +Y direction. Thus, the electrical connectivity between the cartridge side electrical connection part and the device side electrical connection part can be improved.

(3) In the cartridge of the aspect described above, the liquid ejection device may include a first positioning part and a second positioning part that extend from the end portion of the +Y direction side of the cartridge accommodation part to the −Y direction side, and are provided in positions that are spaced from each other sandwiching the liquid leading-in part in the X directions. The case may include a first receiving part that receives the first positioning part, and a second receiving part that receives the second positioning part, in the mounting state.

According to the cartridge of this aspect, by receiving of the positioning parts by corresponding receiving parts, positioning of the cartridge at the time of mounting to the cartridge accommodation part is performed properly. Accordingly, the arrangement posture of the cartridge in the liquid ejection device is improved. Especially, positioning of the liquid leading-out port with respect to the liquid leading-in part that is located in a position sandwiched by the two positioning parts is optimized. Thus, the connection state of the liquid leading-out port with respect to the liquid leading-in part is improved.

(4) In the cartridge of the aspect described above, when the cartridge is in the posture of the mounting state, the first receiving part may be located in the −X direction side with respect to the liquid leading-out port, and the second receiving part may be located in the +X direction side with respect to the liquid leading-out port.

According to the cartridge of this aspect, at the time of mounting of the cartridge to the liquid ejection device, the accuracy of positioning of the cartridge with respect to the liquid leading-in part of the liquid ejection device in the X directions of the liquid leading-out port is enhanced by the pair of positioning parts and the pair of receiving parts. Accordingly, the connectivity between the liquid leading-in part and the liquid leading-out port is improved.

(5) In the cartridge of the aspect described above, when the cartridge is in the posture of the mounting state, the cartridge side electrical connection part and the cartridge side fixation structure may be located in between the liquid leading-out port and the first receiving part in the X directions.

According to the cartridge of this aspect, the accuracy of positioning of the cartridge side electrical connection part with respect to the device side electrical connection part is enhanced together with the accuracy of positioning of the liquid leading-out port with respect to the liquid leading-in part in the X directions, by the pair of positioning parts and the pair of receiving parts. Accordingly, the connectivity with the liquid leading-in part, and the electrical connectivity between the device side electrical connection part and the cartridge side electrical connection part are improved. In addition, the distance between the first receiving part and the second receiving part in the X directions becomes larger for the length in which the cartridge side electrical connection part and the cartridge side fixation structure are provided in between the liquid leading-out port and the first receiving part. Thus, the accuracy of positioning by the pair of positioning parts and the pair of receiving part is further enhanced.

(6) In the cartridge of the aspect described above, the first receiving part has a first opening part in which the first positioning part is inserted, and the second receiving part has a second opening part in which the second positioning part is inserted. In the posture of the mounting state, an opening width of the second opening part in the X directions may be larger than an opening width of the first opening part in the X directions.

According to the cartridge of this aspect, the second receiving part is inserted with the second positioning part and there can be an extra margin in an angle in the X directions when the positioning is started. Thus, easiness of mounting of the cartridge to the liquid ejection device can be improved. By such margin, a stress generated in the connection portion in connection between the liquid ejection device and the cartridge can be alleviated.

(7) According to a second aspect of the present disclosure, a liquid ejection system is provided. This liquid ejection system includes a liquid ejection device, and a cartridge. It is defined that parallel directions to a gravity direction are Z directions, the same direction as the gravity direction among the Z directions is +Z direction, the opposite direction from the gravity direction among the Z directions is −Z direction, an orthogonal direction to the Z directions are Y directions, one direction of the Y directions is +Y direction, the other direction of the Y directions is −Y direction, an orthogonal direction to the Z directions and the Y directions are X directions, one direction of the X directions is +X direction, and the other direction of the X directions is −X direction.

The liquid ejection device includes: a housing provided with a cartridge accommodation part in the inside; a device side fixation structure that extends from the end portion of the +Y direction side of the cartridge accommodation part to the −Y direction side; a liquid leading-in part located in the end portion of the +Y direction side of the cartridge accommodation part; and a device side electrical connection part located in the end portion of the +Y direction side of the cartridge accommodation part. The cartridge is configured so as to be attachable to and detachable from the liquid ejection device. The cartridge includes: a case configured to insert to the cartridge accommodation part by moving along the +Y direction; an accommodation part provided in the inside of the case and configured to accommodate liquid; a liquid leading-out port configured to accept the liquid leading-in part in a mounting state where the cartridge is mounted to the liquid ejection device; a cartridge side electrical connection part configured to contact electrically with the device side electrical connection part while receiving a force having a component of at least the +Z direction, from the device side electrical connection part in the mounting state; and a cartridge side fixation structure configured to engage with the device side fixation structure in the mounting state. The case is restricted moving in the −Y direction in a state of being imparted with the force directing in the −Z direction by engagement of the device side fixation structure and the cartridge side fixation structure in the mounting state. The device side fixation structure and the cartridge side electrical connection part are provided at positions where they overlap with each other at least in a part when the cartridge in a posture of the mounting state is viewed in the Z direction. In the posture of the mounting state, a width of the cartridge in the Z directions is smaller than a width in the Y directions and a width in the X directions.

According to the liquid ejection system of this aspect, at least a part of the force of the +Z direction received by the cartridge side electrical connection part from the device side electrical connection part in the cartridge is reduced by the force of the −Z direction imparted to the cartridge side fixation structure by the device side fixation structure for forming an engagement state of the case. Accordingly, the component of the force in the Z directions imparted to the cartridge is reduced, the arrangement posture of the cartridge is prevented from shifting from a proper posture to the Z directions, and the connection state of the cartridge with respect to the liquid ejection device is improved. Further, an unnecessary force is prevented from generating at a connection portion between the liquid ejection device and a liquid accommodation body due to deterioration of the arrangement posture of the cartridge. Thus, the connection portion is prevented from being damaged and degraded. By the liquid ejection system of this aspect, the width in the Z directions of the cartridge in the posture of the mounting state is smaller than the other width in the X directions and Y directions. Thus, the arrangement posture of the cartridge in the liquid ejection device is further stabilized. Therefore, the connection state of the cartridge with respect to the liquid ejection device is further improved.

(8) In the liquid ejection system of the aspect described above, the cartridge side electrical connection part has a contact surface that contacts with the device side electrical connection part in the mounting state. A normal vector of the contact surface may have a vector component of the −Z direction and a vector component of the +Y direction when the cartridge is in the posture of the mounting state.

According to the liquid ejection system of this aspect, the electrical connection state between the cartridge side electrical connection part and the device side electrical connection part can be formed by utilizing a force of the case moving in the +Y direction. Thus, the electrical connectivity between the cartridge side electrical connection part and the device side electrical connection part can be improved.

(9) In the liquid ejection system of the aspect described above, the liquid ejection device may include a first positioning part and a second positioning part that extend from the end portion of the +Y direction side of the cartridge accommodation part to the −Y direction side, and are provided in positions that are spaced from each other sandwiching the liquid leading-in part in the X directions. The cartridge may include a first receiving part that receives the first positioning part, and a second receiving part that receives the second positioning part, in the mounting state.

According to the liquid ejection system of this aspect, by receiving of the positioning parts of the liquid ejection device by the corresponding receiving parts of the cartridge, positioning of the cartridge in mounting to the cartridge accommodation part is performed properly. Accordingly, the arrangement posture of the cartridge in the liquid ejection device is improved. Especially, positioning of the liquid leading-out port of the cartridge with respect to the liquid leading-in part of the liquid ejection device that is located in a position sandwiched by the two positioning parts is optimized. Thus, the connection state of the liquid leading-out port with respect to the liquid leading-in part is improved.

(10) In the liquid ejection system of the aspect described above, when the cartridge is in the posture of the mounting state, the first receiving part may be located in the −X direction side with respect to the liquid leading-out port, and the second receiving part may be located in the +X direction side with respect to the liquid leading-out port.

According to the liquid ejection system of this aspect, at the time of mounting of the cartridge to the liquid ejection device, the accuracy of positioning of the cartridge with respect to the liquid leading-in part of the liquid ejection device in the X directions of the liquid leading-out port is enhanced by the pair of positioning parts and the pair of receiving parts. Accordingly, the connectivity between the liquid leading-in part and the liquid leading-out port is improved.

(11) In the liquid ejection system of the aspect described above, when the cartridge is in the posture of the mounting state, the cartridge side electrical connection part and the cartridge side fixation structure may be located in between the liquid leading-out port and the first receiving part in the X directions.

According to the liquid ejection system of this aspect, the accuracy of positioning of the cartridge side electrical connection part with respect to the device side electrical connection part is enhanced together with the accuracy of positioning of the liquid leading-out port with respect to the liquid leading-in part in the X directions, by the pair of positioning parts and the pair of receiving parts. Accordingly, the connectivity with the liquid leading-in part, and the electrical connectivity between the device side electrical connection part and the cartridge side electrical connection part are improved. In addition, by a larger distance between the first receiving part and the second receiving part in the X directions, for the cartridge side electrical connection part and the cartridge side fixation structure provided in between the liquid leading-out port and the first receiving part, the accuracy of positioning by the pair of positioning parts and the pair of receiving part is further enhanced.

(12) In the liquid ejection system of the aspect described above, the first receiving part has a first opening part in which the first positioning part is inserted, and the second receiving part has a second opening part in which the second positioning part is inserted. In the posture of the cartridge in the mounting state, an opening width of the second opening part in the X directions may be larger than an opening width of the first opening part in the X directions.

According to the liquid ejection system of this aspect, there can be an extra margin in an angle in the X directions when the second receiving part is inserted with the second positioning part. Thus, connectivity of the cartridge with respect to the liquid ejection device can be improved. By such margin, a stress generated in the connection portion in connection between the liquid ejection device and the cartridge can be alleviated.

(13) In the liquid ejection system of the aspect described above, the device side fixation structure and the cartridge side fixation structure may be configured so that, when being in an engagement state where device side fixation structure and the cartridge side fixation structure engage with each other, the case is pushed in the +Y direction to release the engagement state, and this allows movement of the case in the −Y direction.

According to this liquid ejection system, attaching and detaching operation of the cartridge to the liquid ejection device is simplified. Thus, convenience for a user is enhanced.

Not all the plurality of components included in the aspects of the present disclosure described above are essential. In order to solve a part or all of the problem described above, or achieve a part or all of the effects described in this specification, a part of the plurality of components can be changed, deleted, and switched with new other component, and a part of limitation thereof can be deleted, as appropriate. In order to solve a part or all of the problem described above, or achieve a part or all of the effect described in this specification, a part or all of the technical features included in one aspect of the present disclosure described above can be combined with a part or all of the technical features included in the other aspect of the present disclosure described above to obtain an independent one aspect of the present disclosure.

The present disclosure can be realized in various aspects other than a liquid accommodation body and a liquid ejection system. For example, the present disclosure can be realized in aspects such as a connection method and a connection structure of a liquid ejection device or a liquid accommodation body in a liquid ejection device. In this specification, a "system" means a configuration aspect in which a plurality of components cooperates with each other in order to exhibit one or more functions. The "system" includes not only an aspect in which a part or all of the plurality of components are arranged in places apart from each other and cooperate with each other, but an aspect in which the plurality of components cooperate with each other in a single device.

DETAILED DESCRIPTION

A. First Embodiment

A configuration of a liquid ejection device 10 to which a cartridge 100 of a first embodiment is mounted will be described with reference to FIG. 1 to FIG. 5 and a configuration of the cartridge 100 will be described with reference to FIG. 6 to FIG. 16. In this specification, the liquid ejection device 10 in a state of being mounted with the cartridge 100 is also referred to as a "liquid ejection system 11".

Figure 1:
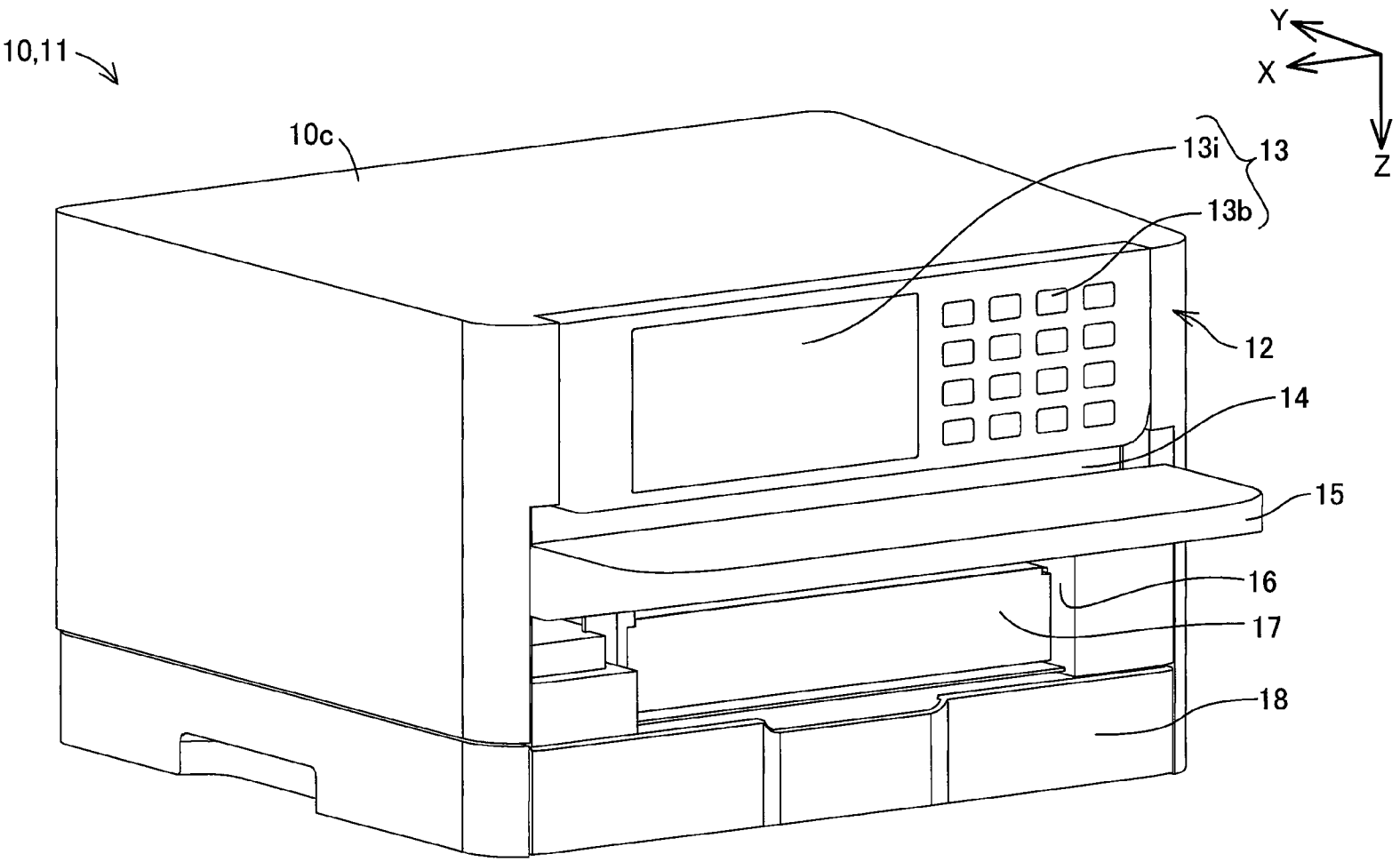
FIG. 1 is a schematic perspective view showing an exterior configuration of a liquid ejection device.

A1. Configuration of Liquid Ejection Device:

Exterior Configuration of Liquid Ejection Device:

FIG. 1 is a schematic perspective view showing an exterior configuration of the liquid ejection device 10 composing the liquid ejection system 11. FIG. 1 shows arrows X, Y, Z indicating three directions orthogonal to each other. The arrows X, Y, Z are shown also in other drawings referred to in this specification, as appropriate, so as to correspond to FIG. 1

The directions indicated by the arrows X, Y, Z correspond to an arrangement posture of the liquid ejection device 10 in a normal using state. The normal using state of the liquid ejection device 10 means a state when the liquid ejection device 10 is arranged in a horizontal surface to be used. Hereinafter, the directions parallel to the arrows X, Y, Z are referred to as "X directions", "Y directions", "Z directions", respectively. Among the X directions, one direction is referred to as "+X direction" and the other direction is referred to as "−X direction". Similarly, among the Y, Z directions, one direction is referred to as "+Y direction" or "+Z direction", and the other direction is referred to as "−Y direction" or "−Z direction".

The X, Y, Z directions will be described in an order of the Z directions, the Y directions, and the X directions. The Z directions indicate parallel directions to the gravity direction. The +Z direction is the gravity direction and the −Z direction is an opposite direction from the gravity direction. The Z directions are the same direction as a vertical direction (height direction) of the liquid ejection device 10. In the description below, description of "upper" or "lower" for the liquid ejection device 10 means the vertical direction based on the direction of the arrow Z unless otherwise noted. The "upper" means the −Z direction and the "lower" means the +Z direction.

The Y directions indicate parallel directions to a longitudinal direction (depth direction) of the liquid ejection device 10. The +Y direction is a direction extending from a front surface side to a back-surface side of the liquid ejection device 10, and on the contrary, the −Y direction is a direction extending from the back-surface side of the liquid ejection device 10 to a frontal surface side. In the description below, description of "front" or "rear" for the liquid ejection device 10 means the front and rear direction based on the direction of the arrow Y unless otherwise noted. The "front" means the −Y direction and the "rear" means the +Y direction.

The X directions indicate parallel directions to a left-right direction (width direction) of the liquid ejection device 10. The +X direction is the same direction as a direction extending from a right side to a left side when the liquid ejection device 10 is viewed from a position confronting to the front surface of the liquid ejection device 10, and on the contrary, the −X direction is the same direction as a direction extending from the left side to the right side. In the description below, description of "right" or "left" for the liquid ejection device 10 means the right and left direction based on the direction of the arrow X unless otherwise noted. The "right" means the −X direction and the "left" means the +X direction.

All of the X, Y, Z directions in the description below for the cartridge 100 are based on a posture in a mounting state of being mounted appropriately to the liquid ejection device 10 in the normal using state.

In the present embodiment, the liquid ejection device 10 is an inkjet printer, and the liquid ejection system 11 is a printing system of an inkjet method. The liquid consumed by jetting in the liquid ejection device 10 of the present embodiment is ink. The liquid ejection device 10 discharges ink droplets and records ink dot to a medium that is a processing target, to form an image. The medium is, for example, a printing paper. The liquid ejection device 10 of the present embodiment includes a housing 10*c* that is a resin hollow box body composing the exterior of the liquid ejection device 10. The housing 10*c* has a substantially rectangular shape. The housing 10*c* has a front surface part 12 that faces to the −Y direction side and is assumed to confront to a user when the user operates the liquid ejection device 10. The front surface part 12 is provided with an operation part 13, a medium discharge port 14, a medium receiving part 15, a medium accommodation port 16, a medium accommodation part 17, and a cover member 18.

The operation part 13 has a display part 13*i* that displays information to the user, a plurality of operation buttons 13*b* that receive operation by the user. The medium discharge port 14 is an outlet of the medium sent out from the inside of the liquid ejection device 10. The medium discharge port 14 is formed as a slit-shaped opening part of which width is wide in the X direction, and opens in the −Y direction. The medium receiving part 15 projects in a shape of eave in the −Y direction in the lower side of the medium discharge port 14, and receives the medium discharged from the medium discharge port 14.

The medium accommodation port 16 is an opening part for supply of a medium to the liquid ejection device 10 by the user. In the present embodiment, the medium accommodation port 16 opens in the −Y direction in the lower part of the medium receiving part 15, and has a substantially rectangular opening shape having a wide width in the X direction. The medium accommodation part 17 is a tray-shaped member that accommodates stock of the medium. The medium accommodation part 17 is accommodated in the medium accommodation port 16 in a state where the front surface of the medium accommodation part 17 is viewed from the outside of the liquid ejection device 10 via the medium accommodation port 16. The user can replenish the medium to the liquid ejection device 10 by accommodating the medium in the medium accommodation part 17 drawn in the −Y direction from the liquid ejection device 10 via the medium accommodation port 16, and loading again the medium accommodation part 17 from the medium accommodation port 16 to the liquid ejection device 10.

The cover member 18 is a resin plate-shaped member composing a part of the exterior of the liquid ejection device 10. In the present embodiment, the cover member 18 has a substantially rectangular shape having a wide width in the X direction, and is arranged below the medium accommodation port 16. The cover member 18 has a claw part (not shown in figures) in an outer circumferential edge of the cover member 18, and is attached attachably to and detachably from the housing 10*c*. The cover member 18 protects the plurality of cartridges 100 accommodated in the inside of the liquid ejection device 10 by covering the cartridges 100.

Figure 2:
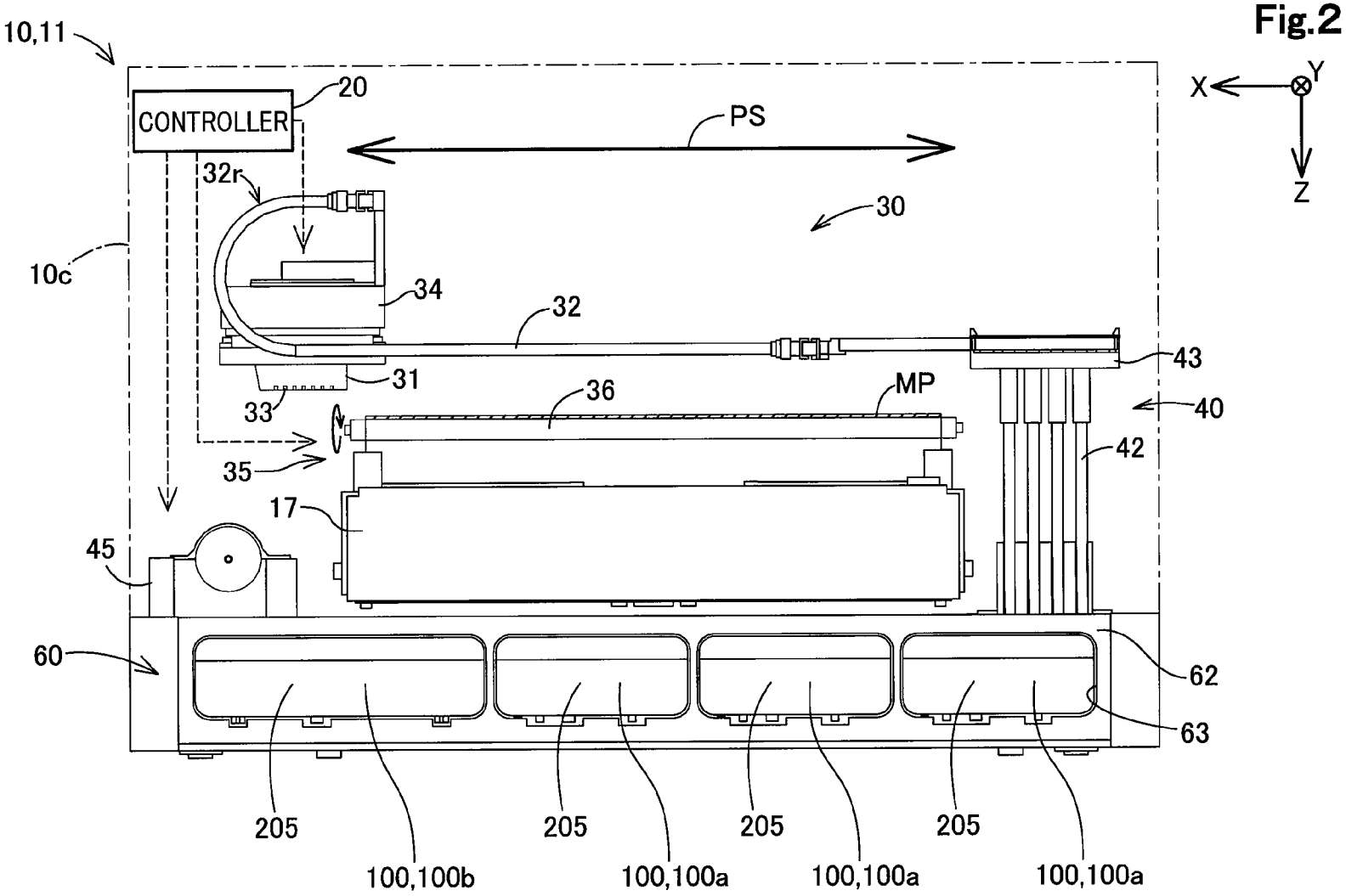
FIG. 2 is a first schematic view showing an interior configuration of the liquid ejection device.
Figure 3:
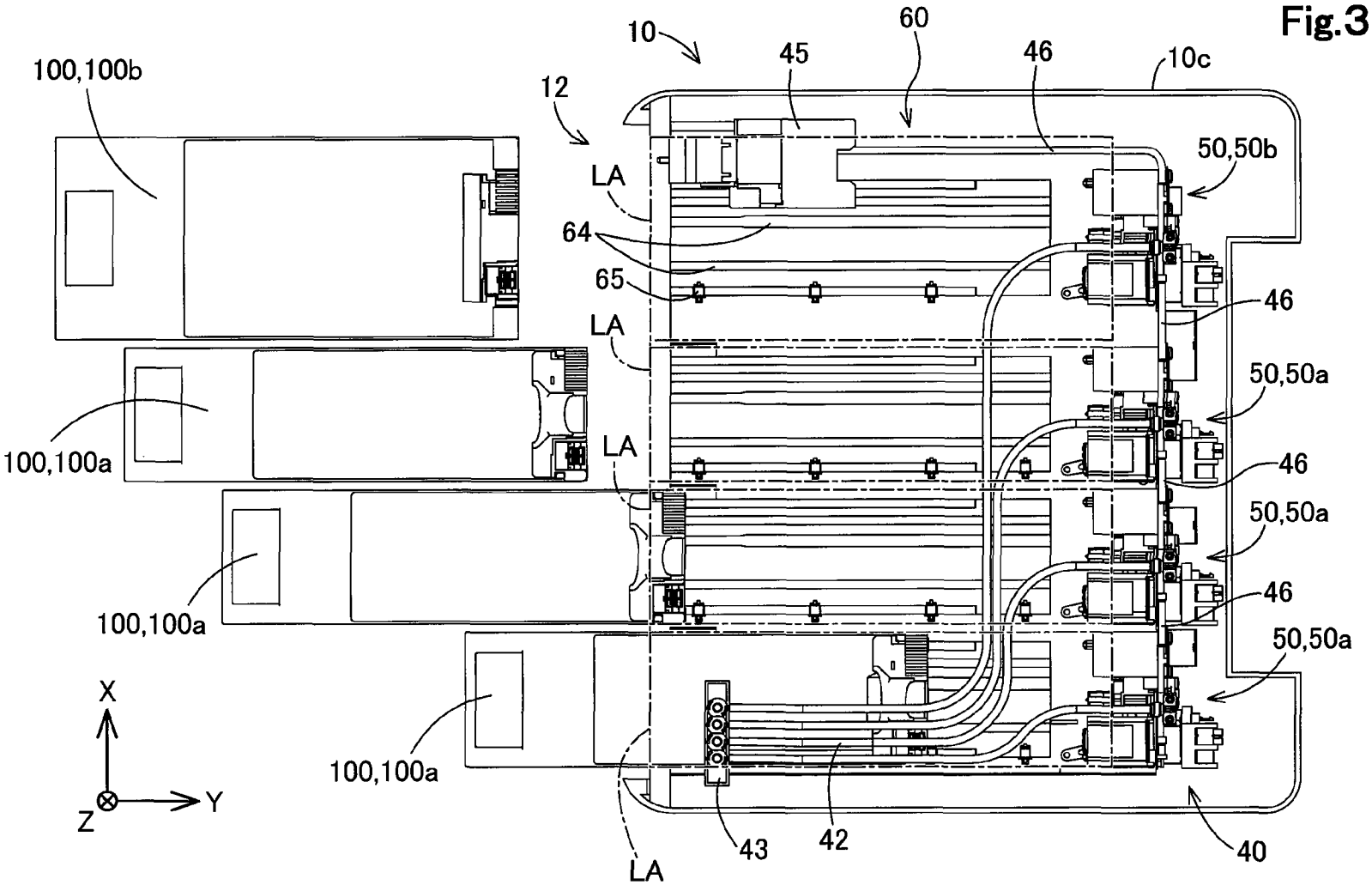
FIG. 3 is a second schematic view showing the interior configuration of the liquid ejection device.

Interior Configuration of Liquid Ejection Device:

Referring to FIG. 2 to FIG. 5 sequentially, overview of the interior configuration of the liquid ejection device 10 will be described with. FIG. 2 is a schematic view when the liquid ejection device 10 is viewed in the +Y direction, excluding the housing 10*c* and the cover member 18. FIG. 2 shows a controller 20, a ejection execute unit 30, a medium convey unit 35, a liquid supply unit 40, and a cartridge accommodation part 60 that are extracted from among main components of the liquid ejection device 10. FIG. 3 is a schematic view when the liquid ejection device 10 is viewed in the +Z direction, excluding the housing 10*c* and the cover member 18. FIG. 3 does not show the controller 20, the ejection execute unit 30, and the medium convey unit 35 that are shown in FIG. 2. FIG. 3 shows, for convenience, a state where the plurality of cartridges 100 are drawn in the −Y direction from an arrangement region LA that is a mounting position in which mounting to the liquid ejection device 10 is finished.

The liquid ejection device 10 includes the controller 20, the ejection execute unit 30, the medium convey unit 35, the liquid supply unit 40, and the cartridge accommodation part 60 (shown in FIG. 2). In the liquid ejection device 10, liquid is supplied via a supply piping 42 of the liquid supply unit 40 from the cartridge 100 accommodated in the cartridge accommodation part 60 to the ejection execute unit 30. A printing image is formed in a medium MP by discharge of the liquid by the ejection execute unit 30 to the medium MP that is sent out and conveyed from the medium accommodation part 17 by the medium convey unit 35. The controller 20, the ejection execute unit 30, the medium convey unit 35, the liquid supply unit 40, and the cartridge accommodation part 60 will be described sequentially.

Controller:

The controller 20 controls driving of components in the liquid ejection device 10. The controller 20 is configured by a micro-computer including at least a central processing unit, and a main memory. The controller 20 exhibits various functions by reading and executing of various programs in the main memory by the central processing unit. The functions of the controller 20 will be described sequentially.

Ejection Execute Unit:

The ejection execute unit 30 includes a head part 31, and a plurality of tubes 32 shown in FIG. 2. The head part 31 receives supply of the liquid from the liquid supply unit 40 via the plurality of tubes 32. A supply mechanism of the liquid from the liquid supply unit 40 will be described later. The head part 31 includes a liquid chamber (not shown in figures) that accommodates the liquid supplied from the liquid supply unit 40. A bottom surface of the liquid chamber is provided with a nozzle 33 that opens downward. The head part 31 discharges the liquid in the liquid chamber from the nozzle 33 under control of the controller 20 by a known method such as pressure application to the ink by a piezo element.

In the present embodiment, the head part 31 is mounted to a carriage 34 and is configured to reciprocate linearly in the X direction under control of the controller 20. FIG. 2 shows a two-direction arrow PS indicating a moving direction and a moving range of the head part 31. In the present embodiment, a main scanning direction of the liquid ejection device 10 is the same direction as the X direction. The ejection execute unit 30 includes a guide axis for movement of the carriage 34, a motor that generates a driving force, and a pulley that transfers the driving force, as a driving mechanism for movement of the head 31. Illustration and detailed description thereof are omitted.

The plurality of tubes 32 connected to the head part 31 have flexibility. The tubes 32 are arrayed in parallel in the Y direction. The tubes 32 are arranged in a substantially liner shape in the +X direction along a scanning path of the head part 31 from a joint part 43 that is a connection portion between the liquid supply unit 40 and the supply piping 42 described later, and the tubes 32 are curved upward, folded back in the −X direction, and connected to the head part 31. Curved portions 32r of the tubes 32 displace in the X direction according to the movement of the head part 31. Thereby, main scanning of the head part 31 is prevented from being inhibited by the tubes 32 and movement operation of the head part 31 is smoothed.

Medium Convey Unit:

The medium convey unit 35 conveys the medium MP that is the processing target, under control of the controller 20 shown in FIG. 2. The medium convey unit 35 includes a conveyance roller 36 installed in the X direction in the lower part of the head part 31. The lower part of the conveyance roller 36 is arranged with the medium accommodation part 17 described above. The medium convey unit 35 includes a sending out mechanism (not shown in figures) that sends out the medium MP one by one from the medium accommodation part 17 onto an outer circumferential side surface of the conveyance roller 36. The medium convey unit 35 rotates the conveyance roller 36 by a driving motor (not shown in figures) to move the medium MP in the −Y direction in the lower part of the head part 31, by the rotation driving force. In the present embodiment, a sub scanning direction of the liquid ejection device 10 is the same direction as the −Y direction. The medium MP that has passed a lower region of the head part 31 is discharged to the outside of the liquid ejection device 10 via the medium discharge port 14 shown in FIG. 1.

When the printing processing in the liquid ejection device 10 is performed, the controller 20 causes the medium convey unit 35 to convey the medium MP in the sub scanning direction described above. In an upper part of the conveyance roller 36, the controller 20 causes the head part 31 to reciprocate in the main scanning direction along the conveyance roller 36, and causes the head part 31 to discharge ink droplets toward a printing surface of the medium MP in a timing determined on the basis of printing data. Thereby, ink dots are recorded on the medium MP in the position determined on the basis of the printing data, and an image based on the printing data is formed.

Figure 4:
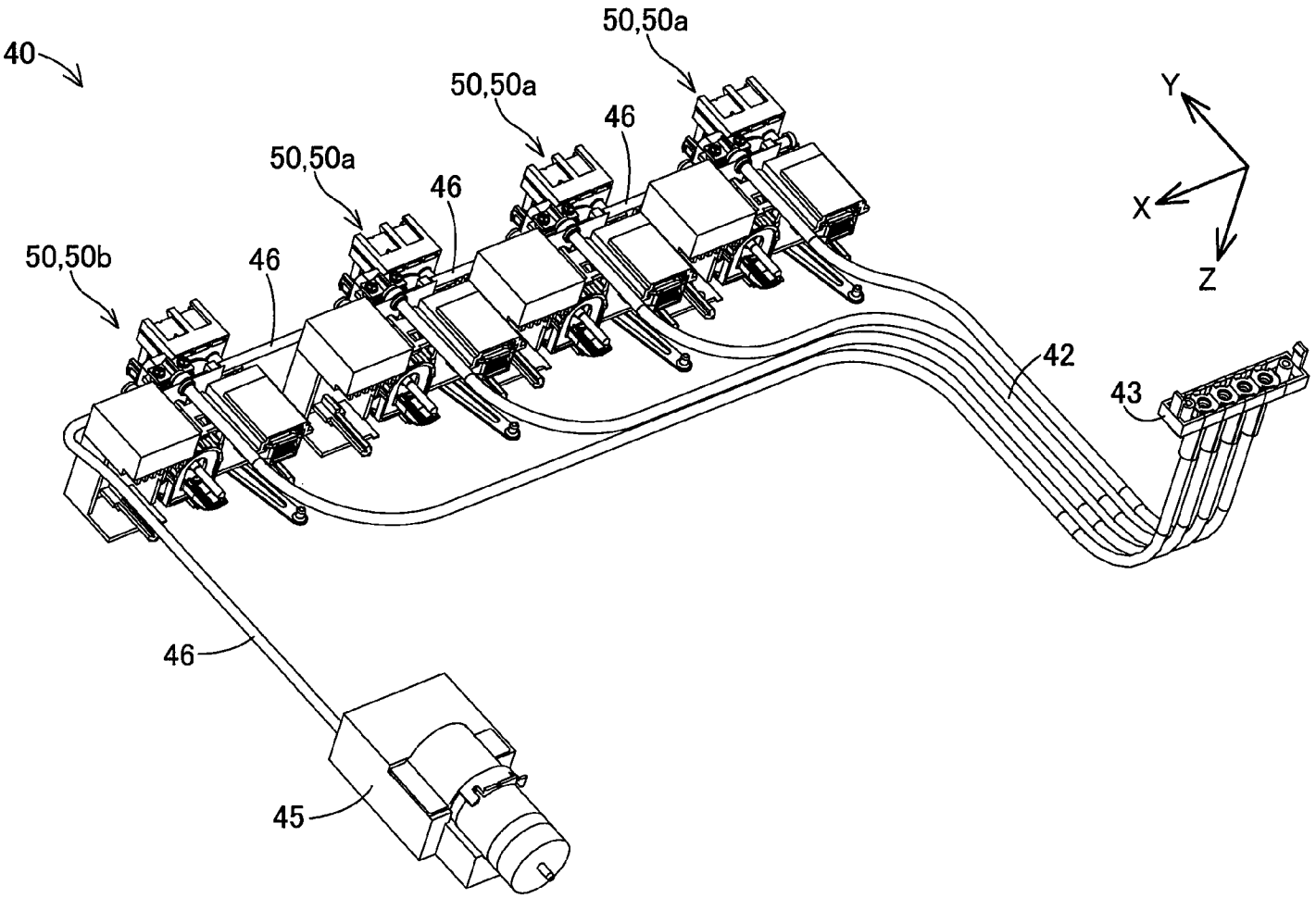
FIG. 4 is a schematic perspective view extracting and showing a liquid supply unit.

Liquid Supply Unit:

The liquid supply unit 40 will be described with reference to FIG. 4 together with FIG. 2 and FIG. 3. FIG. 4 is a schematic perspective view extracting and showing the liquid supply unit 40. The liquid supply unit 40 includes a plurality of connection accept unit 50, a variable pressure generation part 45, and a pressure transfer piping 46 (see FIG. 3, FIG. 4), in addition to the plurality of supply piping 42 and the joint part 43 described above. First, the configuration of the plurality of connection accept unit 50 will be described. Next, the supply piping 42 and the joint part 43 will be described. Then, the variable pressure generation part 45 and the pressure transfer piping 46 composing a liquid suction and delivery mechanism will be described.

Connection Accept Unit:

The liquid supply unit 40 is connected to each of the cartridges 100 accommodated in the cartridge accommodation part 60 via the connection accept unit 50. In the liquid ejection device 10 of the present embodiment, four cartridges 100 for each color are mounted as described later. Therefore, in the present embodiment, the liquid supply unit 40 includes four connection accept unit 50 so as to correspond to each of the four cartridges 100.

In the liquid ejection device 10 of the present embodiment, the four cartridges 100 include three first cartridges 100*a* each having the same volume for accommodating liquid, and one second cartridge 100*b* having larger volume for accommodating liquid than the first cartridges 100*a*. Thus, the plurality of connection accept unit 50 include three first connection accept unit 50*a* corresponding to the first cartridges 100*a*, and one second connection receiving part 50*b* corresponding to the second cartridge 100*b*. The first connection accept unit 50*a* and the second connection receiving part 50*b* are collectively referred to as the "connection accept unit 50", unless distinction is needed. Similarly, the first cartridge 100*a* and the second cartridge 100*b* are collectively referred to as the "cartridges 100", unless distinction is needed. In the present embodiment, there are not so many substantial differences in configuration for connection with the cartridge, between the first connection receiving part 50*a* and the second connection receiving part 50*b*.

The plurality of connection accept unit 50 are installed in an end portion of the +Y direction side of the cartridge accommodation part 60 shown in FIG. 3. The connection accept unit 50 are arrayed in one row in the X direction in the lowermost stage in the deepest position of the back-surface side in the liquid ejection device 10. The connection accept unit 50 are installed so as to receive connection of the corresponding cartridge 100 from the −Y direction. The three first connection accept unit 50*a* are installed in parallel with almost equal intervals from the right side. The second connection receiving part 50*b* is installed in the most left side.

Figure 5:
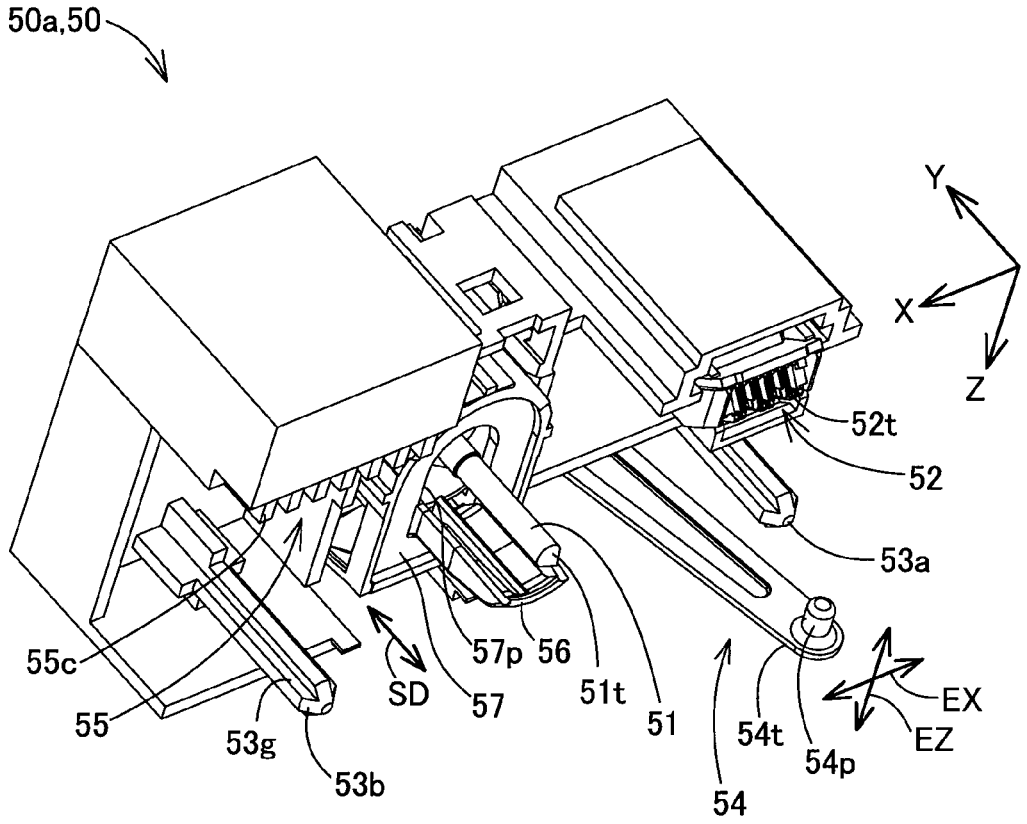
FIG. 5 is a schematic perspective view extracting and showing a connection receiving part included in the liquid supply unit.

The schematic configuration of the connection accept unit 50 will be described with reference to FIG. 5. FIG. 5 is a schematic perspective view extracting and showing a part of the first connection accept unit 50*a* among the connection accept unit 50. Description described below is common in the first connection accept unit 50*a* and the second connection receiving part 50*b* unless otherwise noted. Each of the connection receiving part 50 is configured as one component in which a liquid leading-in part 51, a device side electrical connection part 52, a first positioning part 53*a*, a second positioning part 53*b*, a device side fixation structure 54, and a fitting structure 55 are integrated.

To the liquid leading-in part 51, the liquid from the cartridge 100 flows in. In the present embodiment, the liquid leading-in part 51 is located in the end portion of the +Y direction side of the cartridge accommodation part 60. The liquid leading-in part 51 is composed of a tube part having a shape extending linearly in the −Y direction, and opens in a tip end portion 51*t* of the −Y direction side. The liquid leading-in part 51 is connected to the cartridge 100 by insertion of the tip end portion 51*t* to a liquid leading-out port (described later) of the cartridge 100. In the present embodiment, the liquid leading-in part 51 projects in the −Y direction in approximately at the center of the connection receiving part 50 in the X direction.

A rear end portion of the +Y direction side of the liquid leading-in part 51 communicates with a pump chamber (not shown in figures) provided in the inside of the connection receiving part 50. The liquid flown into the liquid leading-in part 51 flows in the pump chamber. The inside of the connection receiving part 50 is provided with a check valve structure for preventing the liquid flown in the pump chamber from flowing back to the liquid leading-in part 51 again (not shown in figures).

In the connection receiving part 50 of the present embodiment, a liquid receiving part 56 is provided below the liquid leading-in part 51. The liquid receiving part 56 extends out in the −Y direction along the liquid leading-in part 51. The liquid receiving part 56 is slightly curved downward along a side surface shape of the lower side of the liquid leading-in part 51, and functions as a receiving tray for receiving liquid leaked from the connection portion between the liquid leading-in part 51 and the cartridge 100. The liquid receiving part 56 may be omitted.

In a rear end part of the +Y direction side of the liquid leading-in part 51 and the liquid receiving part 56, a base end member 57 is provided. The base end member 57 is a resin member having a through hole 57*p* in which the liquid leading-in part 51 is inserted. The base end member 57 is attached so as to move in the Y direction. In a back-surface side of the base end member 57, a helical spring that is an energizing member is arranged so as to enclose a circumference of the liquid leading-in part 51, and imparts an elastic force of the −Y direction, to the base end member 57. Thereby, the base end member 57 elastically moves in the Y direction as indicated by an arrow SD. When the cartridge 100 is mounted to the liquid ejection device 10, the cartridge 100 is imparted with a force of the −Y direction from the base end member 57.

The device side electrical connection part 52 is a connector electrically connected to the cartridge 100. The device side electrical connection part 52 is located in the end portion of the +Y direction side of the cartridge accommodation part 60 shown FIG. 3. The device side electrical connection part 52 has a plurality of terminal parts 52*t* arrayed in the X direction. Each of the terminal parts 52*t* projects from the surface of the device side electrical connection part 52, and contacts with a cartridge side electrical connection part (described later) of the cartridge 100 to be electrically connected to the cartridge side electrical connection part. It is desirable that each of the terminal parts 52*t* is energized to the projection direction of the terminal parts 52*t* by an elastic member such as a leaf spring. In the present embodiment, the device side electrical connection part 52 is arranged in an inclination angle corresponding to an arrangement angle of the cartridge side electrical connection part of the cartridge 100. The device side electrical connection part 52 is arranged so as to be directed diagonally upward so that a normal vector of the surface of the device side electrical connection part 52 has a vector component of the −Y direction and a vector component of the −Z direction.

The device side electrical connection part 52 is connected to the controller 20 shown in FIG. 2 via wiring which is not shown in figures. The wiring is composed by, for example, a flexible flat cable. The controller 20 sends and receives an electrical signal with the cartridge 100 due to the electrical connection between the device side electrical connection part 52 and the cartridge side electrical connection part. Thereby, the controller 20 acquires information on the liquid accommodated in the cartridge 100. The "information on the liquid" includes, for example, a color of the ink, a type of the ink, and a parameter indicating an accommodation amount of the liquid in the cartridge 100. The controller 20 electrically detects a connection state of the cartridge 100.

The first positioning part 53*a* and the second positioning part 53*b* project in positions that are apart from each other. In the present embodiment, the first positioning part 53*a* and the second positioning part 53*b* are configured as shaft-shaped members extending in the −Y direction, and are arrayed in parallel with the liquid leading-in part 51. The first positioning part 53*a* is located in the −X direction side of the liquid leading-in part 51 and the second positioning part 53*b* is located in the +X direction side of the liquid leading-in part 51. The first positioning part 53*a* is located in the −X direction side further from the device side electrical connection part 52. In the present embodiment, positions of tip end portions in the Y direction of the first positioning part 53*a* and the second positioning part 53*b* are almost aligned with each other. The first positioning part 53*a* and the second positioning part 53*b* are provided in the almost same height, and in a lower position than the liquid leading-in part 51 and the device side electrical connection part 52.

When the cartridge 100 is mounted, both the first positioning part 53*a* and the second positioning part 53*b* are inserted in corresponding receiving parts (described later) provided in the cartridge 100. The first positioning part 53*a* and the second positioning part 53*b* have a function of defining an arrangement position in the X direction and an arrangement angle in a horizontal direction, of the cartridge 100 when the cartridge 100 is mounted.

It is desirable that the first positioning part 53*a* and the second positioning part 53*b* project in the −Y direction side from the tip end portion 51*t* of the liquid leading-in part 51. Thereby, the liquid leading-in part 51 can be connected to the cartridge 100 after the mounting posture of the cartridge 100 is defined by the pair of positioning parts 53*a*, 53*b*. It is desirable that groove portions 53g extending in parallel with the Y direction are provided in outer circumferential side surfaces of the positioning parts 53*a*, 53*b*, as shown in figures. Thereby, insertion of the cartridge 100 to the receiving part is smoothed.

The device side fixation structure 54 cooperates with a cartridge side fixation structure (described later) included in the cartridge 100 to restrict movement of the cartridge 100 mounted in the liquid ejection device 10 in the Y direction.

In the present embodiment, the device side fixation structure 54 extends out toward the −Y direction side so as to enter the lower side of the cartridge 100 to be mounted. The device side fixation structure 54 is configured as an arm-shaped member part. The device side fixation structure 54 is located in the −X direction side further from the liquid leading-in part 51 and is located below the device side electrical connection part 52. A tip end portion 54*t* of the −Y direction side of the device side fixation structure 54 projects in the −Y direction side from the tip end portion 51*t* of the liquid leading-in part 51. The tip end portion 54*t* projects in the −Y direction side from the tip end portions of the positioning parts 53*a*, 53*b*. The tip end portion 54*t* is provided with a projection portion 54*p*. The projection portion 54*p* projects in the −Z direction in the center of the tip end portion 54*t*. The projection potion 54*p* engages with an engaged part provided in the cartridge side fixation structure in a mounting state where the cartridge 100 is mounted to the cartridge accommodation part 60. In the description below, the projection portion 54*p* is sometimes referred to as an "engaging part 54*p*". Engagement of the projection portion 54*p* with the engaged part provided in the cartridge side fixation structure restricts the cartridge 100 moving in the −Y direction.

As indicated by a two-direction arrow EX, the device side fixation structure 54 is attached in a state where rotation in a horizontal direction is allowed with the rear end potion of the +Y direction side as a fulcrum. The device side fixation structure 54 is energized in the +X direction by an elastic member (not shown in figures) arranged inside the connection receiving part 50. The device side fixation structure 54 elastically rotates in the −X direction with receiving the elastic force in the +X direction when receiving an external force in the −X direction. As indicated by a two-direction arrow EZ, the device side fixation structure 54 is attached in a state where rotation in a height direction is allowed with the rear end portion of the +Y direction side as a fulcrum. The device side fixation structure 54 is energized in the −Z direction by the elastic member (not shown in figures) arranged inside the connection receiving part 50. The device side fixation structure 54 elastically rotates in the +Z direction with receiving the elastic force in the −Z direction when receiving an external force in the +Z direction. The mechanism of engagement of the device side fixation structure 54 and the cartridge side fixation structure of the cartridge 100 will be described later.

The fitting structure 55 is provided in the +X direction side further from the liquid leading-in part 51. The fitting structure 55 is located above the second positioning part 53*b*, and has an irregular structure in which a plurality of projection portions 55*c* projecting in the +Z direction in the same height, extending in parallel in the −Y direction, and having a substantially rectangular shape, are arrayed. An array pattern of the projection portions 55*c* in the irregular structure of the fitting structure 55 varies for each of the connection accept unit 50. The cartridge 100 corresponding to each of the connection accept unit 50 is provided with a fitting structure receiving part (described later) having an irregular structure that corresponds to and is engageable to the array pattern of the irregular structure. Thereby, a wrong cartridge 100 that does not correspond to the connection receiving part 50 is prevented from being connected to the connection receiving part 50.

Supply Piping and Joint Part:

The plurality of supply piping 42 is composed of a resin tube member having flexibility shown in FIG. 4. One supply piping 42 is connected to each of the pump chambers (not shown in figures) described above, that are provided inside the connection accept unit 50. The supply piping 42 passes from the connection receiving part 50, above the region in which the cartridge 100 is accommodated, is collected to the end portion of the −X direction side, and then, is laid in parallel with the −Y direction (see FIG. 3, FIG. 4) Then, the supply piping 42 is laid in the −Z direction in the end portion of the front side of the liquid ejection device 10, and is connected to the joint part 43 that is installed in the higher position than the medium convey unit 35 shown in FIG. 2, FIG. 4. As described above, the supply piping 42 is connected to corresponding one of the plurality of tubes 32 of the ejection execute unit 30 via the joint part 43.

Liquid Suction and Delivery Mechanism in Liquid Supply Unit:

The variable pressure generation part 45 is a generation source that generates pressure variation for liquid suction and delivery, and is composed of, for example, a pump shown in FIG. 2, FIG. 3. The variable pressure generation part 45 is installed upper than the cartridge accommodation part 60 in a position that is close to the front surface part 12 of the liquid ejection device 10. The variable pressure generation part 45 is located above the mounting position of the first cartridge 100*a*. The pressure transfer piping 46 is connected to the variable pressure generation part 45, and transfers the pressure variation generated by the variable pressure generation part 45. The pressure transfer piping 46 is connected to the pressure chamber (not shown in figures) provided inside the connection accept unit 50.

The pressure chamber of each of the connection accept unit 50 is adjacent to the pump chamber described above, into which the liquid is flown from the cartridge 100, with a flexible film therebetween. Therefore, when the pressure of the pressure chamber is decreased by the variable pressure generation part 45, a flexible film is deflected to the pressure chamber side, the volume of the pump chamber increases, and the liquid of the cartridge 100 is sucked to the pump chamber via the liquid leading-in part 51. On the other hand, when the variable pressure generation part 45 increases the pressure of the pressure chamber, the flexible film deflects in the pump chamber side, the volume of the pump chamber decreases, and the liquid flown into the pump chamber is pushed out to the supply piping 42. In this way, in the liquid supply unit 40, by repetition of increasing and decreasing of the pressure in the pressure chamber by the variable pressure generation part 45, liquid supply to the ejection execute unit 30 is realized.

Cartridge Accommodation Part

In the liquid ejection device 10 of the present embodiment, the cartridge accommodation part 60 is provided in the lowermost stage shown in FIG. 2, FIG. 3. In the cartridge accommodation part 60, the cartridges 100 are accommodated by being arrayed in one row in the X directions. FIG. 3 shows an arrangement region LA that is an arrangement position at the time of mounting of the cartridge 100 in the cartridge accommodation part 60, by a dot-and-dash line.

In the cartridge accommodation part 60, the second cartridge 100*b* is accommodated in the end of the +X direction side, and the three first cartridges 100*a* are accommodated in the −X direction side thereof (see FIG. 2). In the +Y direction side of the arrangement region LA of each of the cartridges 100, one corresponding connection receiving part 50 is installed (see FIG. 3). As described above, in the present embodiment, the cartridges 100 accommodate different color inks. Combination of the color inks accommodated in the cartridges 100 is not limited particularly. For example, the three first cartridges 100*a* may accommodate cyan, magenta, and yellow, and the second cartridge 100*b* may accommodate black that is predicted to be most consumed. Some or all of the cartridges 100 may accommodate the same color ink. Detail of attachment and detachment of the cartridge 100 with respect to the liquid ejection device 10 will be described later.

The cartridge accommodation part 60 includes an opening member 62 shown in FIG. 2. The opening member 62 is a plate-shaped member having a substantially rectangular shape, and includes four through holes 63 passing through in a thickness direction. The opening member 62 is fixedly installed in the end portion of the −Y direction side of the cartridge accommodation part 60 in a state of having a thickness direction that is the same direction as the Y directions, and a longitudinal direction that is the same direction as the X directions. The through holes 63 are insertion ports in which the cartridges 100 are inserted. Each of the through holes 63 has an opening shape corresponding to an outer circumferential contour shape when the corresponding cartridge 100 is viewed in the Y directions. Insertion and drawing of the cartridge 100 to and from the liquid ejection device 10 is guided by the opening member 62. In addition, the user is prevented from inserting the first cartridge 100*a* and the second cartridge 100*b* in wrong places. The opening member 62 may be omitted.

A floor surface of the cartridge accommodation part 60 is formed with a plurality of rail grooves 64 shown in FIG. 3. The rail grooves 64 are formed linearly across the whole region in the Y directions of the cartridge accommodation part 60 for every arrangement region LA of the cartridges 100. Each of the rail grooves 64 are fitted with a rail rib (described later) provided in the lower surface of the cartridge 100. Movement of the cartridge 100 in the Y directions in the inside of the liquid ejection device 10 is guided by the rail grooves 64 and contact between the adjacent cartridges 100 in the X directions is prevented. In addition, connection of the cartridge 100 to the connection receiving part 50 is simplified. The configuration of the rail grooves 64 and the configuration of the corresponding rail rib may be varied for each of the cartridges 100, for prevention of wrong mounting. A part or all of the rail grooves 64 may be omitted.

The floor surface of the cartridge accommodation part 60 is installed with a plurality of rollers 65 shown in FIG. 3. The rollers 65 are arrayed by being dispersed as appropriate in the Y directions for each arrangement region LA of the cartridges 100. In the cartridge accommodation part 60, movement resistance when the cartridges 100 are moved in the Y directions by rotation of the rollers 65 is reduced, and movement operation of the cartridge 100 by the user is smoothed. The roller 65 may be omitted.

A2. Configuration of Cartridge:

Referring to FIG. 6 to FIG. 10 as appropriate, the configuration of the first cartridge 100*a* will be described with. After that, the configuration of the second cartridge 100*b* will be described with reference to FIG. 11 to FIG. 14.

Figure 6:
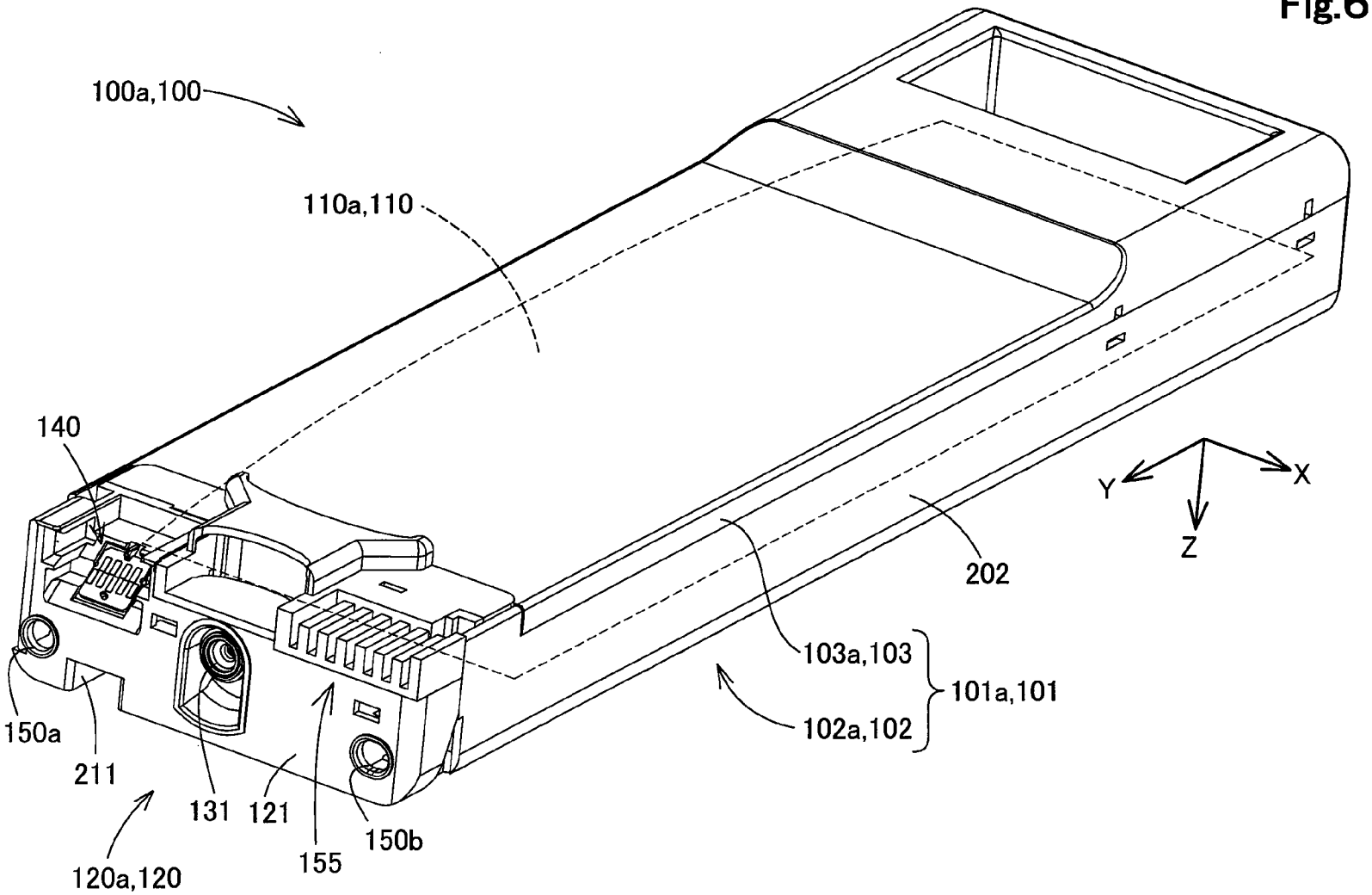
FIG. 6 is a schematic perspective view showing a configuration of an upper surface side of a first cartridge.
Figure 7:
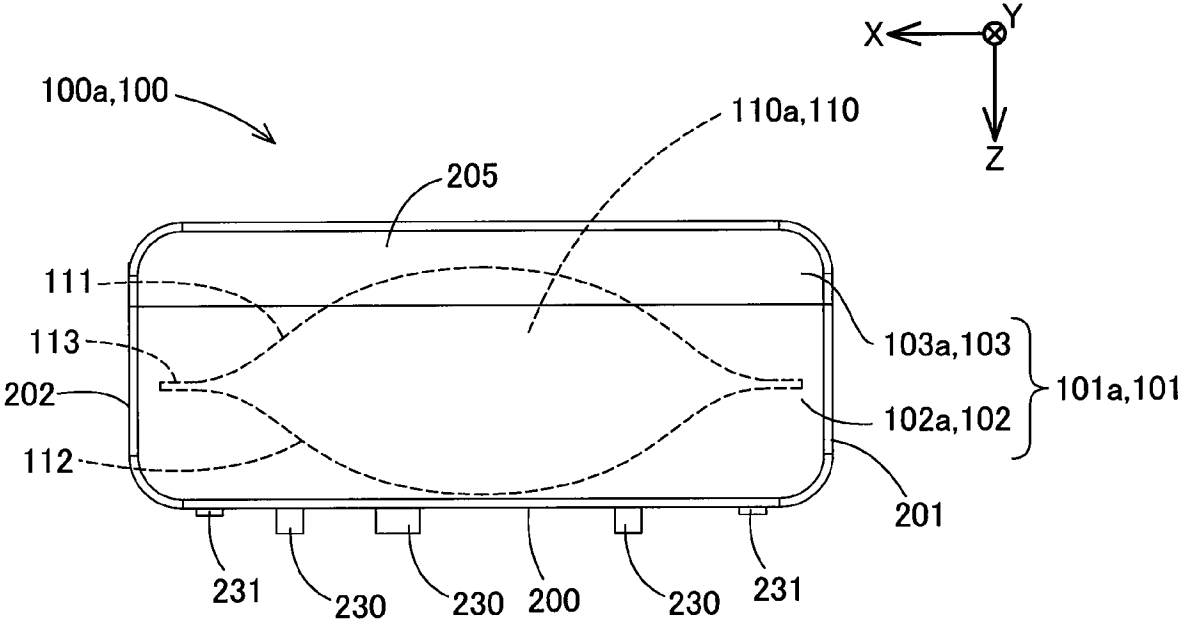
FIG. 7 is a schematic view when the first cartridge is viewed in +Y direction.
Figure 8:
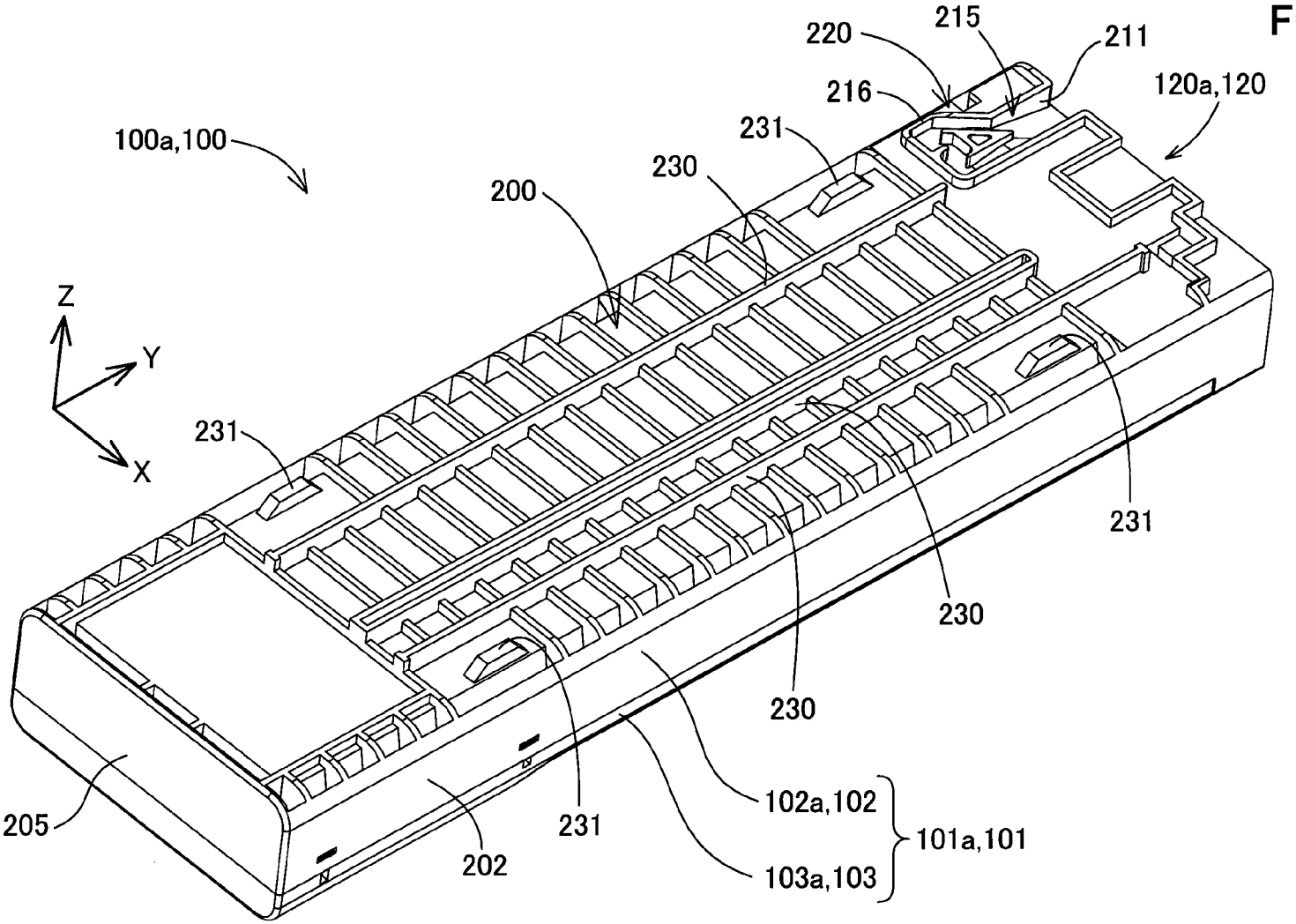
FIG. 8 is a schematic perspective view showing a configuration of a lower surface side of the first cartridge.

First Cartridge:

FIG. 6 is a schematic perspective view showing a configuration of the upper surface side of the first cartridge 100*a*. FIG. 7 is a schematic view when the first cartridge 100*a* is viewed in the +Y direction. FIG. 8 is a schematic perspective view showing a lower surface side of the first cartridge 100*a*. In the present embodiment, the cartridge 100 has a substantially rectangular parallelepiped shape with the longitudinal direction as the Y directions shown in FIG. 6. Hereinafter, the surface of the first cartridge 100*a* directed in the −Z direction is referred to as an "upper surface", and the surface directed in the +Z direction is referred to as a "lower surface". This is similar for the second cartridge 100*b* described later.

The width of the first cartridge 100*a* in the Z directions is smaller than the width in the X directions and the width in the Y directions. This "width" means a distance in each direction between portions located at the outermost side of the first cartridge 100*a* in each direction. The first cartridge 100*a* has a thin flat plate shape. Thus, with the first cartridge 100*a*, the arrangement posture when being mounted to the liquid ejection device 10 can be highly stabilized as shown in FIG. 6.

The first cartridge 100*a* includes a first case 101*a*, an accommodation part 110*a*, and a connection part 120*a* as shown in FIG. 6. The first case 101*a* is a hollow box body composing a casing of the first cartridge 100*a*. The first case 101*a* is inserted to the cartridge accommodation part 60 by moving in the +Y direction with respect to the cartridge accommodation part 60 when the first cartridge 100*a* is mounted to the liquid ejection device 10. The accommodation part 110*a* accommodates liquid. The accommodation part 110*a* is accommodated inside the first case 101*a*. In FIG. 6 and FIG. 7, since the accommodation part 110*a* cannot be seen from outside the first case 101*a*, the accommodation part 110*a* is shown schematically by a broken line, for convenience. The connection part 120*a* is provided in the tip end portion (end portion of the +Y direction side) in the mounting direction of the first cartridge 100*a*, and is located in the +Y direction side of the accommodation part 110*a*. The first cartridge 100*a* is connected to the first connection receiving part 50*a* of the liquid ejection device 10 in the connection part 120*a*. Following describes the first case 101*a*, the accommodation part 110*a*, and the connection part 120*a*, successively.

First Case:

The first case 101*a* has a substantially rectangular parallelepiped shape with the longitudinal direction as the Y directions. The first case 101*a* is manufactured by, for example, a resin member such as a polypropylene. The first case 101*a* has a tray 102*a*, and a lid member 103*a*. The tray 102*a* is formed as a hollow box body that opens in the −Z direction. The connection part 120*a* composes a wall part of the +Y direction side of the tray 102*a*. In the present embodiment, the whole opening part that opens in the −Z direction of the tray 102*a* is blocked by the lid member 103*a*. The lid member 103*a* is composed of a substantially rectangular plate-shaped member, and is attached so as to be attachable to and detachable from the tray 102*a*. The lid member 103*a* may be configured so as to cover only a part of the opening part of the tray 102*a*. In the first cartridge 100*a*, the lid member 103*a* may be omitted.

The tray 102*a* includes a bottom surface wall part 200, two side wall parts 201, 202, and a front surface wall part 205. The bottom surface wall part 200 is a substantially rectangular-shaped wall part composing the bottom surface part of the tray 102*a*, and extends in the X directions and the Y directions as shown in FIG. 8. In the specification, "extend" means a configuration of extending in a direction continuously. In the present embodiment, the accommodation part 110*a* is arranged on the bottom surface wall part 200 shown in FIG. 6, FIG. 7. The bottom surface wall part 200 has a size of an extent in which at least the whole accommodation part 110*a* is accommodated.

The first side wall 201 is a substantially rectangular-shaped wall part crossing to and coupled to a long side of the −X direction side of the bottom surface wall part 200, and composes a side wall part of the right side of the tray 102*a* as shown in FIG. 7. The second side wall part 202 is a substantially rectangular-shaped wall part crossing to and coupled to a long side of the +X direction side of the bottom surface wall part 200, and composes a side wall part of the left side of the tray 102*a* as shown in FIG. 6, FIG. 7, FIG. 8. The first side wall part 201 and the second side wall part 202 extend across the almost entire region in the Y directions in parallel with each other. The first side wall part 201 and the second side wall part 202 sandwich the accommodation part 110*a* in the X directions as shown in FIG. 7.

The front surface wall part 205 is a wall part having a substantially rectangular-shape crossing to each of the bottom surface wall part 200, the first side wall part 201, and the second side wall part 202, in the end potion of the −Y direction side as shown in FIG. 7. In the present embodiment, the upper end portion of the front surface wall part 205 is composed of the lid member 103*a*. The front surface wall part 205 is arranged in the front surface part 12 side of the liquid ejection device 10 and blocks almost all through holes 63 of the opening member 62, in the mounting state where the first cartridge 100*a* is mounted to the liquid ejection device 10 shown in FIG. 2.

Referring to FIG. 8, the configuration of the lower surface side of the bottom surface wall part 200 will be described. The surface of the +Z direction side of the bottom surface wall part 200 is provided with a groove portion 215 in the end portion of the +Y direction side. In the present embodiment, the groove portion 215 is formed by being enclosed by a rib 216. The groove portion 215 composes a cartridge side fixation structure 220.

As described above, the cartridge side fixation structure 220 cooperates with the device side fixation structure 54 to restrict movement in the Y directions of the first cartridge 100*a* in the mounting state. The cartridge side fixation structure 220 is provided with an engaged part (described later) that engages with the projection portion 54*p* (engaging part 54*p*) of the device side fixation structure 54 (shown in FIG. 5) in a mounting state where the first cartridge 100*a* is arranged in the predetermined arrangement region LA (shown in FIG. 3) of the cartridge accommodation part 60. The engagement of the projection portion 54*p* with the engaged part restricts the first cartridge 100*a* moving in the −Y direction. In the present embodiment, the groove portion 215 composing the cartridge side fixation structure 220 is configured so as to have a heart cam groove structure that is a loop-shaped groove structure described later. The configuration of the cartridge side fixation structure 220 and mechanism of engagement between the engaged part of the cartridge side fixation structure 220 and the projection portion 54*p* (engaging part 54*p*) of the device side fixation structure 54 will be described later.

The surface of the +Z direction side of the bottom surface wall part 200 is provided with a plurality of rail ribs 230, and a plurality of leg parts 231. The rail ribs 230 are configured as projection wall parts that project in the +Z direction (see FIG. 7), and extend linearly in an almost certain width in the Y directions (see FIG. 8). As described above, the rail ribs 230 fit with the rail grooves 64 (see FIG. 3) provided in the floor surface of the cartridge accommodation part 60, and guide movement in the Y directions of the first cartridge 100*a*. The plurality of leg parts 231 project in the +Z direction and have the same height (see FIG. 7). By the plurality of leg parts 231, the first cartridge 100*a* is properly maintained in the arrangement posture in the arrangement region LA (see FIG. 3) of the cartridge accommodation part 60.

Accommodation Part:

In the present embodiment, the accommodation part 110*a* is composed of a bag-shaped member having flexibility as shown in FIG. 6, FIG. 7. The accommodation part 110*a* has a substantially rectangular shape with the longitudinal direction as the Y directions as shown in FIG. 6. The accommodation part 110*a* is composed by laminating of two sheet members 111, 112 and welding of an outer circumferential edge part 113 thereof (see FIG. 7). The first sheet member 111 is arranged in the −Z direction side and composes the upper side surface of the accommodation part 110*a*. The second sheet member 112 is arranged in the +Z direction side and composes the lower side surface of the accommodation part 110*a*.

The sheet members 111, 112 are formed by a material having flexibility, a gas barrier property, and liquid impermeability. The sheet members 111, 112 may be composed of a film member such as a polyethylene terephthalate (PET), nylon, and polyethylene. The sheet members 111, 112 may be configured by laminating of a plurality of the films composed by the material described above. In this case, for example, an outer layer may be formed by a PET or nylon film having excellent anti-shock property, and an inner layer may be formed by a polyethylene film having excellent ink resistance. The lamination structure is added with a layer in which aluminum or the like is deposited.

Figure 9:
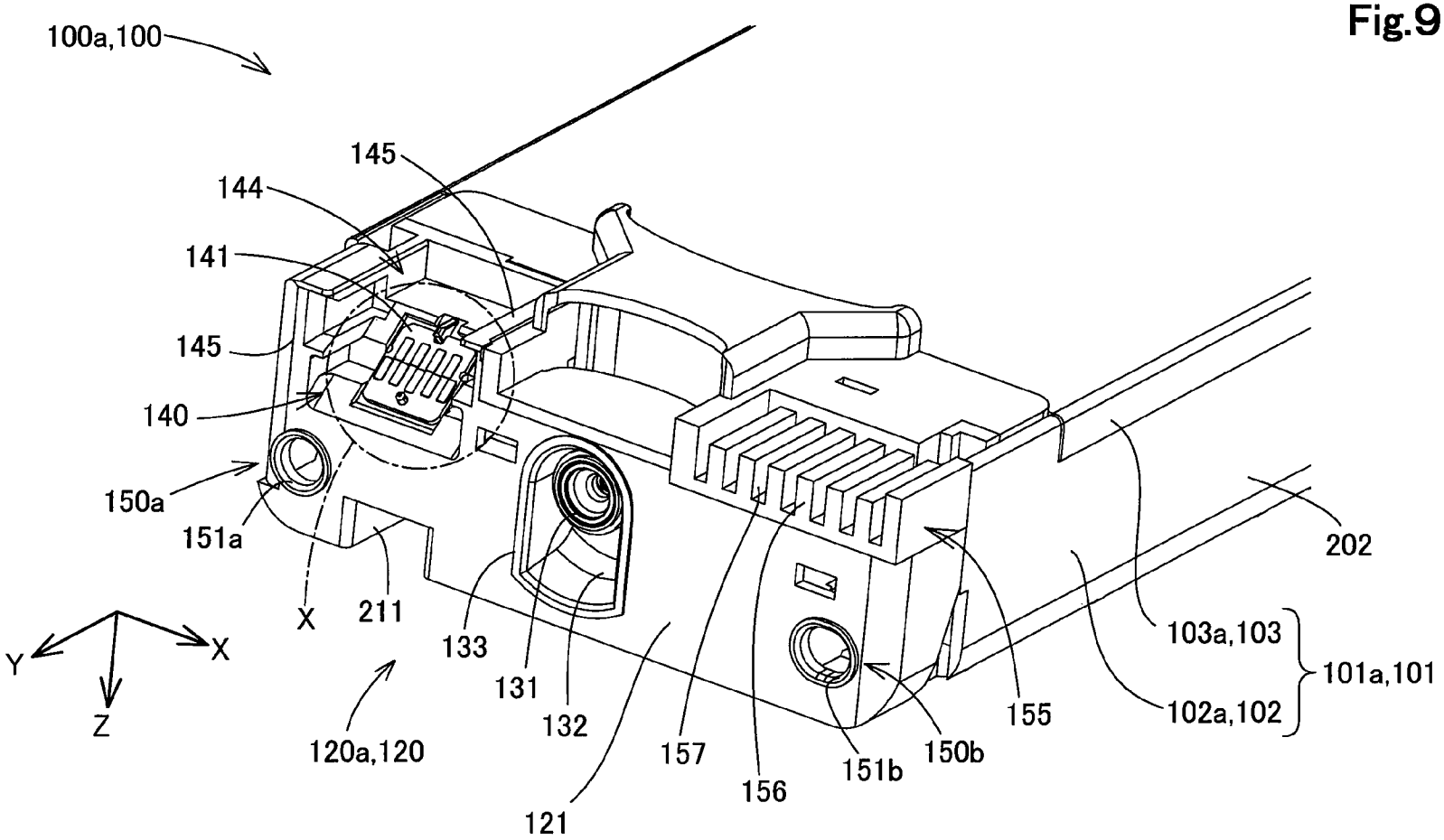
FIG. 9 is a schematic perspective view showing vicinity of a connection part of the first cartridge.
Figure 10:
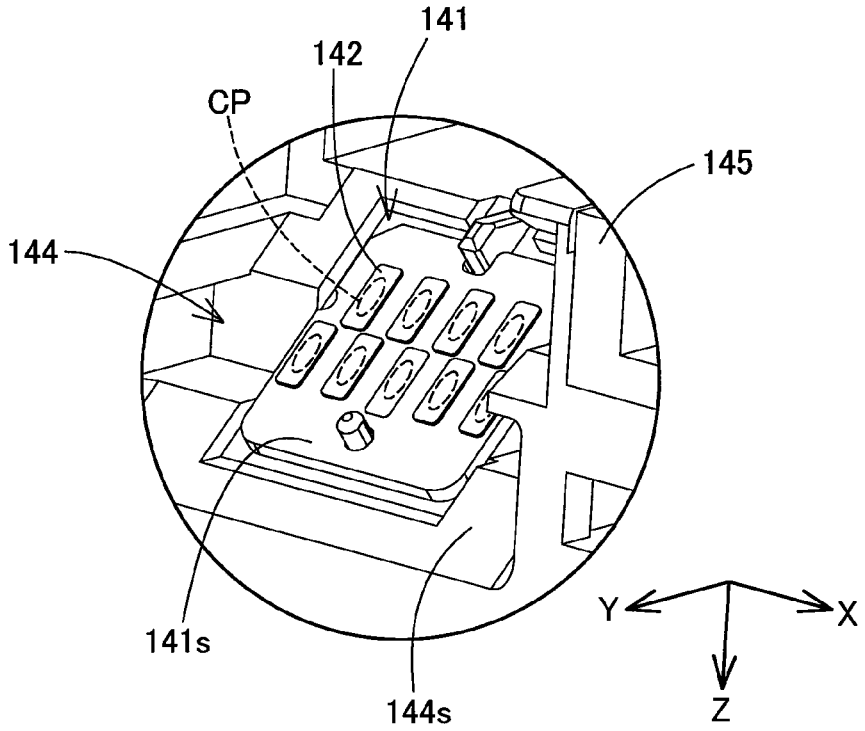
FIG. 10 is a schematic perspective view extracting and showing a formation region of a cartridge side electrical connection part.

Connection Part:

Adding FIG. 9 and FIG. 10 as reference drawings, the configuration of the connection part 120*a* will be described. FIG. 9 is a schematic perspective view showing vicinity of the connection part 120*a*. FIG. 10 is a schematic perspective view extracting and showing a forming region X of the cartridge side electrical connection part 140 enclosed by a dot-and-dash line in FIG. 9.

The connection part 120*a* has a liquid leading-out port 131, the cartridge side electrical connection part 140, a first receiving part 150*a*, a second receiving part 150*b*, a fitting structure receiving part 155, and an inlet concave portion 211, as components for connection with the first connection receiving part 50*a* shown in FIG. 9. In the connection part 120*a*, components thereof are collectively included in a tip end surface 121 that faces in the +Y direction side. Following describes the components thereof, sequentially.

Liquid Leading-Out Port:

The liquid leading-out port 131 is an opening part that opens in the +Y direction as shown in FIG. 9. The liquid leading-out port 131 is inserted with the liquid leading-in part 51 (shown in FIG. 5) of the first connection receiving part 50*a* in the +Y direction. The liquid leading-out port 131 is provided in the almost center position in the X directions in the tip end surface 121 of the connection part 120*a*.

The liquid leading-out port 131 communicates with an internal space of the accommodation part 110*a* (shown in FIG. 7) accommodated in the first case 101*a*. In the present embodiment, the entire circumferential edge part 132 of the liquid leading-out port 131 is concaved in the −Y direction in the tip end surface 121 of the connection part 120*a*. The liquid leading-out port 131 opens in a deep position in the −Y direction side. Thereby, the circumference of the liquid leading-out port 131 is enclosed by a wall part formed by the circumferential edge part 132, and protectivity of the liquid leading-out port 131 is improved. Particularly, for example, the user is prevented from mistakenly touching the liquid leading-out port 131. In addition, degradation such as damage and deformation due to collision of the liquid leading-out port 131 is prevented when the first cartridge 100*a* is mistakenly fallen, and the like.

In the present embodiment, the circumferential edge part 132 of the liquid leading-out port 131 is enclosed by a circumferential edge rib 133 projecting in the +Y direction. When the liquid leading-out port 131 is connected with the liquid leading-in part 51 of the first connection receiving part 50*a*, the circumferential edge rib 133 contacts with the base end member 57 provided in the circumference of the liquid leading-in part 51, is pushed, and receives an elastic force in the −Y direction. In the mounting state where the first cartridge 100*a* is mounted to the liquid ejection device 10, the first cartridge 100*a* is engaged to the first connection receiving part 50*a* (described later). Thus, even when the circumferential edge rib 133 is energized in the −Y direction by the base end member 57, the first cartridge 100*a* is prevented from moving from the arrangement region LA in the −Y direction.

Cartridge Side Electrical Connection Part:

The cartridge side electrical connection part 140 includes a substrate 141 for connecting with the device side electrical connection part 52 as shown in FIG. 9, FIG. 10. The cartridge side electrical connection part 140 electrically contacts with the device side electrical connection part 52 (shown in FIG. 5) of the first connection receiving part 50*a*. A surface 141*s* of the substrate 141 is arranged with a plurality of terminal parts 142 shown in FIG. 10. The terminal parts 142 are arranged in positions corresponding to the terminal parts 52*t* (shown in FIG. 5) of the device side electrical connection part 52. The opposite side surface from the surface 141*s* of the substrate 141 may be provided with a memory for storing information on the liquid, a circuit for detecting connection of the device side electrical connection part 52, and the like (illustration and detailed description are omitted).

In the present embodiment, each of the terminal parts 142 has a substantially flat contact surface with which the terminal part 52*t* of the device side electrical connection part 52 contacts. FIG. 10 illustrates positions of contact portions CP which the terminal parts 52*t* of the device side electrical connection part 52 contact, in the terminal parts 142, by a broken line. The contact portions CP are arrayed in a parallel array direction with the X directions in each of an upper part and a lower part in the surface 141*s* of the substrate 141. The array pattern of the terminal parts 142 and the contact portions CP are not limited to those illustrated in FIG. 10.

In the present embodiment, the cartridge side electrical connection part 140 is provided in a position that is close to the end portion of the −X direction side of the first cartridge 100*a* as shown in FIG. 9. The connection part 120*a* is formed with a substrate arrangement part 144 for arrangement of the substrate 141 of the cartridge side electrical connection part 140 as a concave portion concaved in the −Y direction and the +Z direction. The substrate arrangement part 144 is formed with an inclined surface 144*s* directed in a diagonally upward direction between the +Y direction and the −Z direction as shown in FIG. 10. The cartridge side electrical connection part 140 is inclined and arranged in an almost parallel arrangement angle with the inclined surface 144*s*, on the inclined surface 144*s*. That is, a normal vector of the surface 141*s* of the substrate 141 and the contact surface of the terminal part 52*t* has a vector component of the +Y direction and a vector component of the −Z direction.

In this way, the substrate 141 is arranged so that the surface 141*s* faces to the −Z direction side. Therefore, when the device side electrical connection part 52 is electrically connected, the cartridge side electrical connection part 140 receives a force of the +Z direction from the device side electrical connection part 52 directed at least downward, while electrically contacting with the device side electrical connection part 52. By the force directed downward, a contact state between the cartridge side electrical connection part 140 and the device side electrical connection part 52 becomes preferable, and electrical connectivity of the cartridge side electrical connection part 140 increases.

In the present embodiment, the substrate 141 is inclined and arranged as described above, and the surface 141*s* of the substrate 141 is directed also to the +Y direction side. Therefore, by utilizing a force of the first cartridge 100*a* being pushed in the +Y direction when the first cartridge 100*a* is mounted to the liquid ejection device 10, the electrical connection state between the cartridge side electrical connection part 140 and the device side electrical connection part 52 can be formed. Thus, the electrical connectivity between the cartridge side electrical connection part 140 and the device side electrical connection part 52 increases.

When the cartridge side electrical connection part 140 is connected with the device side electrical connection part 52, the terminal parts 52*t* of the device side electrical connection part 52 slide and move on the contact surface of the terminal parts 142 of the cartridge side electrical connection part 140. Thereby, a foreign matter or the like adhered to the contact surface of the terminal parts 142 of the cartridge side electrical connection part 140 is removed by the terminal parts 52*t* of the device side electrical connection part 52. Thus, the electrical connectivity of the cartridge side electrical connection part 140 further increases.

In addition, when the first cartridge 100*a* is taken out from the cartridge accommodation part 60, by the force of the −Y direction received from the device side electrical connection pat 52, the movement in the −Y direction of the first cartridge 100*a* is assisted. Accordingly, taking out of the first cartridge 100*a* is simplified.

The substrate 141 is installed in a deep position of the substrate arrangement part 144 shown in FIG. 9. The substrate 141 is sandwiched by two wall parts 145 projecting in the −Z direction and the +Y direction from the surface 141*s* of the substrate 141, in both sides in the X directions of the substrate 141. These wall parts 145 function as protection parts of the substrate 141. Therefore, for example, this prevents the user from mistakenly touching the substrate 141, the substrate 141 from being damaged when the first cartridge 100*a* is mistakenly fallen, and the like.

First Receiving Part and Second Receiving Part:

When the first cartridge 100*a* is mounted to the liquid ejection device 10, the first receiving part 150*a* receives the first positioning part 53*a* (shown in FIG. 5) of the first connection receiving part 50*a*, and the second receiving part 150*b* receives the second positioning part 53*b* shown in FIG. 5. Thereby, the mounting position of the first cartridge 100*a* in the cartridge accommodation part 60 is properly defined.

In the present embodiment, the first receiving part 150*a* and the second receiving part 150*b* are formed as a hole part extending in the −Y direction, and have a first opening part 151*a* and a second opening part 151*b*, respectively. The respective opening parts 151*a*, 151*b* of the first receiving part 150*a* and the second receiving part 150*b* receive insertion from the +Y direction side of the corresponding positioning parts 53*a*, 53*b*. In the present embodiment, the first opening part 151*a* of the first receiving part 150*a* and the second opening part 151*b* of the second receiving part 150*b* have different opening shapes. Detail of the shapes will be described later.

The first receiving part 150*a* is located in the −X direction side further from the liquid leading-out port 131. In the first cartridge 100*a*, the first receiving part 150*a* is provided in a corner part of a lower side of the −X direction side in the connection part 120*a*. On the other hand, the second receiving part 150*b* is located in the +X direction side further from the liquid leading-out port 131. In the first cartridge 100*a*, the second receiving part 150*b* is provided in a corner part of a lower side of the +X direction side in the connection part 120*a*.

In the present embodiment, the liquid leading-out port 131 is sandwiched in the X directions by one pair of the receiving parts 150*a*, 150*b*. Thereby, when the first cartridge 100*a* is mounted to the liquid ejection device 10, positioning accuracy in the X directions of the liquid leading-out port 131 with respect to the liquid leading-in part 51 (shown in FIG. 5) increases. Accordingly, connectivity between the liquid leading-in part 51 and the liquid leading-out port 131 is improved. In the present embodiment, a distance in the X directions between the pair of receiving parts 150*a*, 150*b* is large. Thus, the positioning accuracy further increases.

Fitting Structure Receiving Part:

The fitting structure receiving part 155 is provided in the +X direction side further from the liquid leading-out port 131. The fitting structure receiving part 155 is provided in a position that is closer to the end portion of the +X direction side in the connection part 120*a*. The fitting structure receiving part 155 has an irregular structure in which a plurality of substantially rectangular projection portions 156 that project in the same height in the −Z direction and extend in parallel with the −Y direction, are arrayed. The array pattern of the projection portions 156 in the fitting structure receiving part 155 and valley portions 157 formed between the projection portions 156 is reverse in irregularity from the array pattern in the convex-concavity structure of the fitting structure 55 that is a connection target.

When the first cartridge 100*a* is moved in the +Y direction and is connected to the corresponding first connection receiving part 50*a*, fitting between the irregular structure of the fitting structure 55 and the irregular structure of the fitting structure receiving part 155 is allowed. On the other hand, combination between the first cartridge 100*a* and the first connection receiving part 50*a* is not proper, the irregular structure of the fitting structure 55 is not compatible with the irregular structure of the fitting structure receiving part 155 and fitting cannot be performed. Thus, a wrong first cartridge 100*a* that is not corresponding is prevented from being connected to the first connection receiving part 50*a*.

Inlet Concave Portion:

The connection part 120*a* is provided with an inlet concave portion 211 that is a concave portion concaved in the −Z direction and opening in the +Y direction. In the present embodiment, the inlet concave portion 211 has a substantially rectangular shape. The inlet concave portion 211 composes an inlet of the groove portion 215 that composes the cartridge side fixation structure 220 provided in the bottom surface wall part 200 of the first case 101*a* shown in FIG. 8. When the first cartridge 100*a* is mounted to the liquid ejection device 10, the inlet concave portion 211 receives the device side fixation structure 54 (shown in FIG. 5) of the first connection receiving part 50*a*. The inlet concave portion 211 is formed in a position of overlapping with at least a part of the cartridge side electrical connection part 140, when viewed in the Z directions. The reason therefore will be described later.

Other Description for First Cartridge:

As described above, in the first cartridge 100*a*, the first connection part 120*a* is integrated with the tray 102*a* of the first case 101*a*, and the first connection part 120*a* is fixed to the first case 101*a*. Therefore, the arrangement posture and the arrangement position of the cartridge side electrical connection part 140 provided in the first connection part 120*a*, with respect to the first case 101*a* is more stable than a case where the first case 101*a* and the first connection part 120*a* are configured so as to be separable. Accordingly, when the first cartridge 100*a* is mounted to the liquid ejection device 10, the arrangement posture of the cartridge side electrical connection part 140 is prevented from being unstable, and the electrical connectivity with respect to the device side electrical connection part 52 (shown in FIG. 5) is enhanced. Accordingly, further accurate electrical communication between the first cartridge 100*a* and the liquid ejection device 10 can be realized.

In the first cartridge 100*a*, the accommodation part 110*a* is integrated to the first case 101*a*. Therefore, a component for attaching and detaching the accommodation part 110*a* to and from the first case 101*a*, such as a grip part for carrying the accommodation part 110*a* and a positioning part of the accommodation part 110*a* with respect to the first case 101*a*, can be omitted. Accordingly, for the extent of omission of the components, the configuration of the first cartridge can be reduced in size, weight, complexity, and the number of components. In addition, for the extent of omission of the components, the volume of the accommodation part 110*a* can be increased to increase the amount of liquid that can be accommodated.

When the first case 101*a* and the accommodation part 110*a* are integrated, in a replenishment step of the liquid to the liquid ejection device 10, a step in which the user mounts the accommodation part 110*a* to the first case 101*a* can be omitted. Accordingly, convenience for user is improved. In addition, for example, even when an unexpected impact is applied to the first cartridge 100*a* due to unintentional falling of the first cartridge 100*a* by the user, the accommodation part 110*a* is prevented from being detached from the first case 101*a*. Since the first cartridge 100*a* has an integral configuration having the first case 101*a* as a casing, durability of the first cartridge 100*a* with respect to the unexpected impact as described above is enhanced.

Second Cartridge:

Referring to FIG. 11 to FIG. 14, the configuration of the second cartridge 100*b* will be described. In the description and reference drawings below, for a component that is the same as or corresponds to the component of the first cartridge 100*a* described above, the same numeral, or a numeral having the same number but a different alphabet in the end of the numeral is used. The component added with such corresponding numeral exhibits similar function as that of the corresponding component in the first cartridge 100*a*, in the second cartridge 100*b*. Accordingly, various effects described above for the first cartridge 100*a* can be acquired also in the first cartridge 100*b* by such corresponding component. This is similar for the other embodiments described later.

Figure 11:
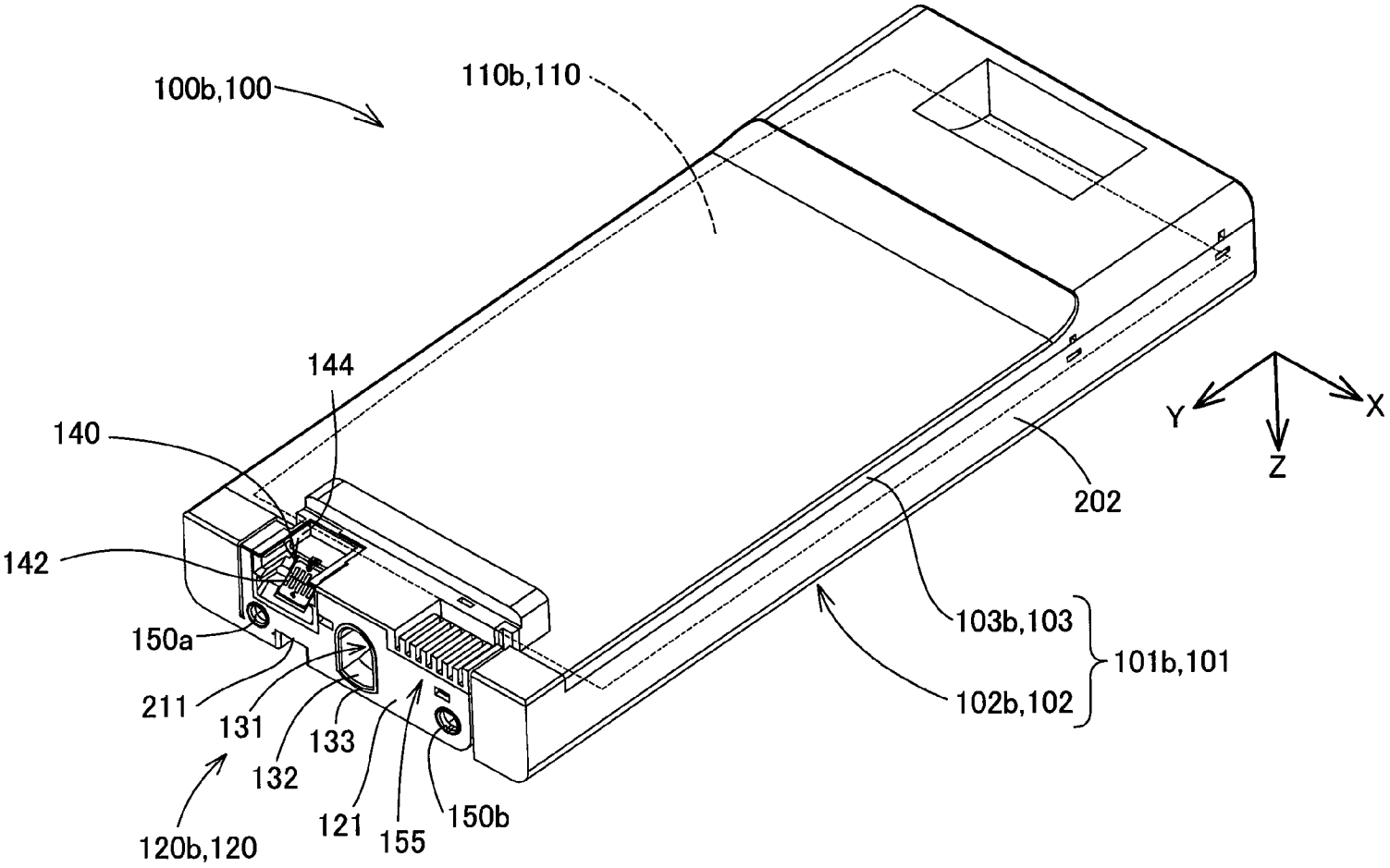
FIG. 11 is a schematic perspective view showing a second cartridge.
Figure 12:
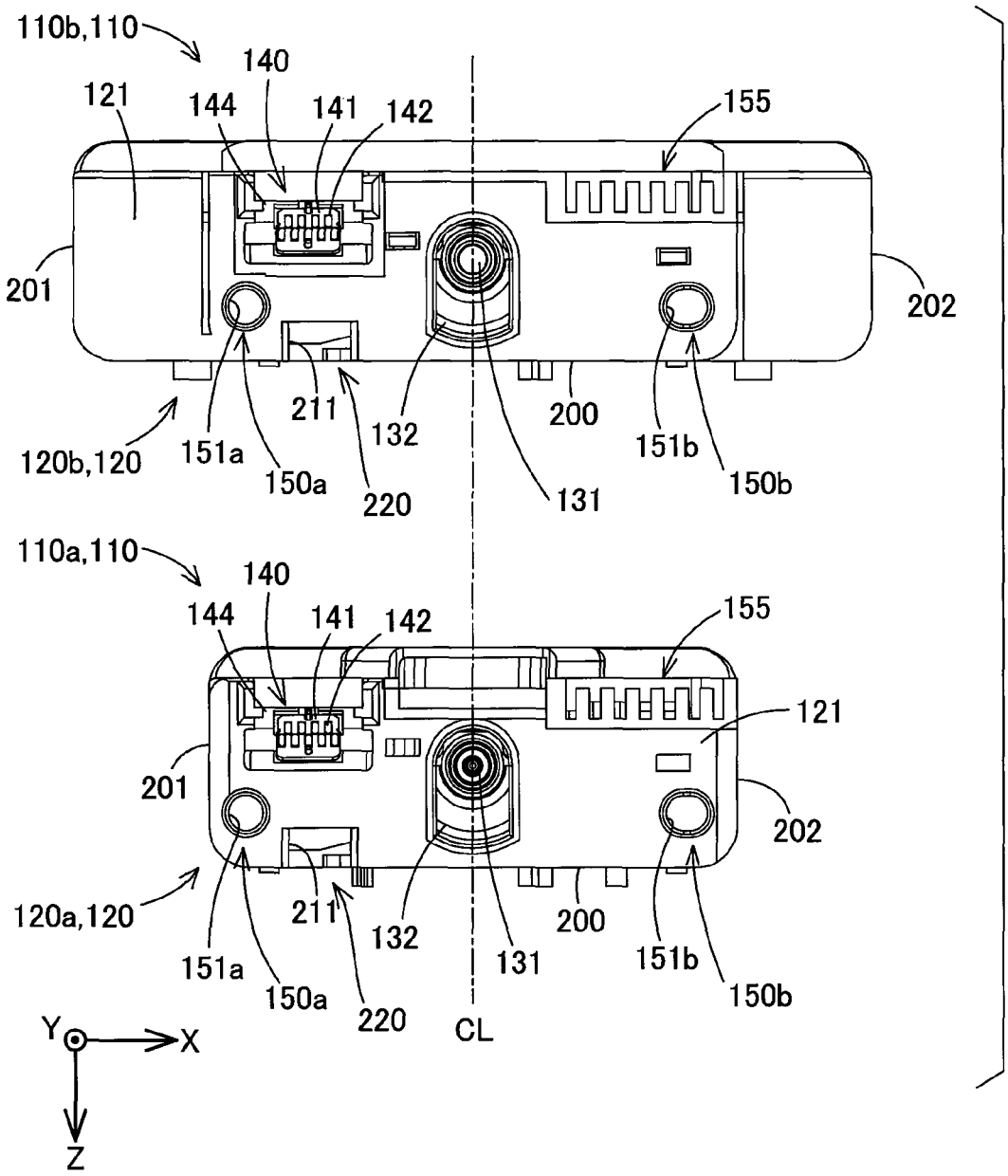
FIG. 12 is a schematic view when the second cartridge is viewed in −Y direction.
Figure 13:
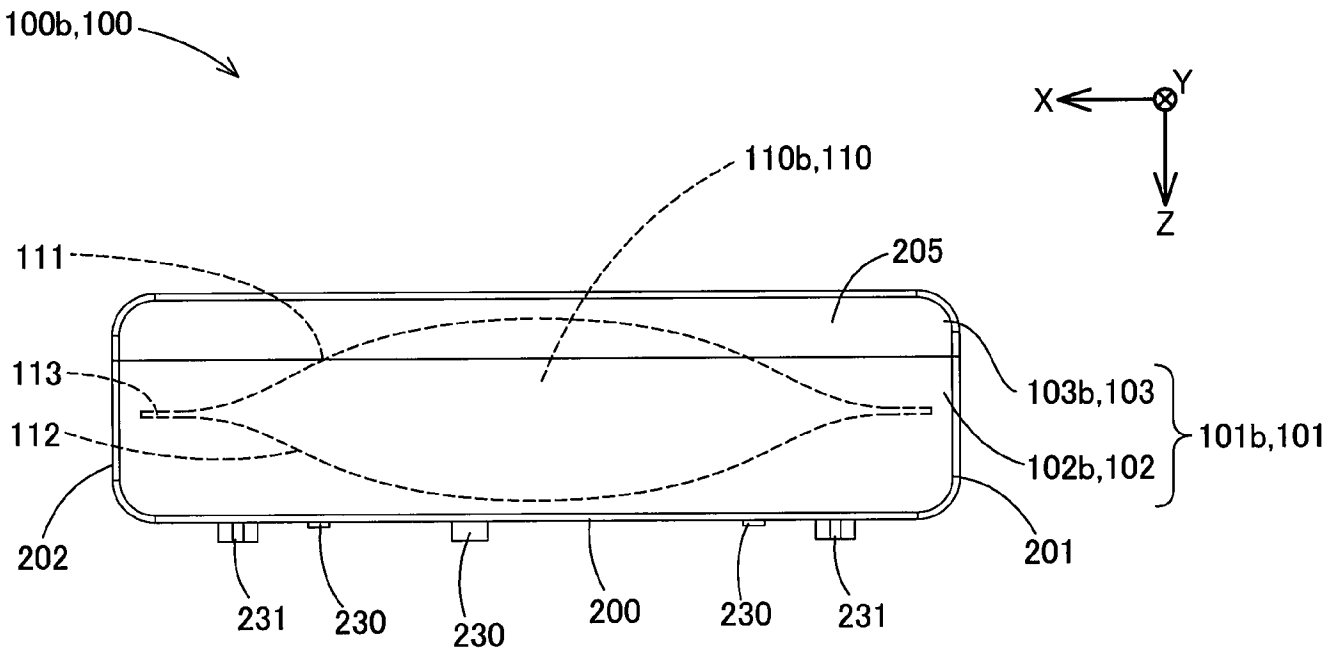
FIG. 13 is a schematic view showing a front surface wall part of the second cartridge.
Figure 14:
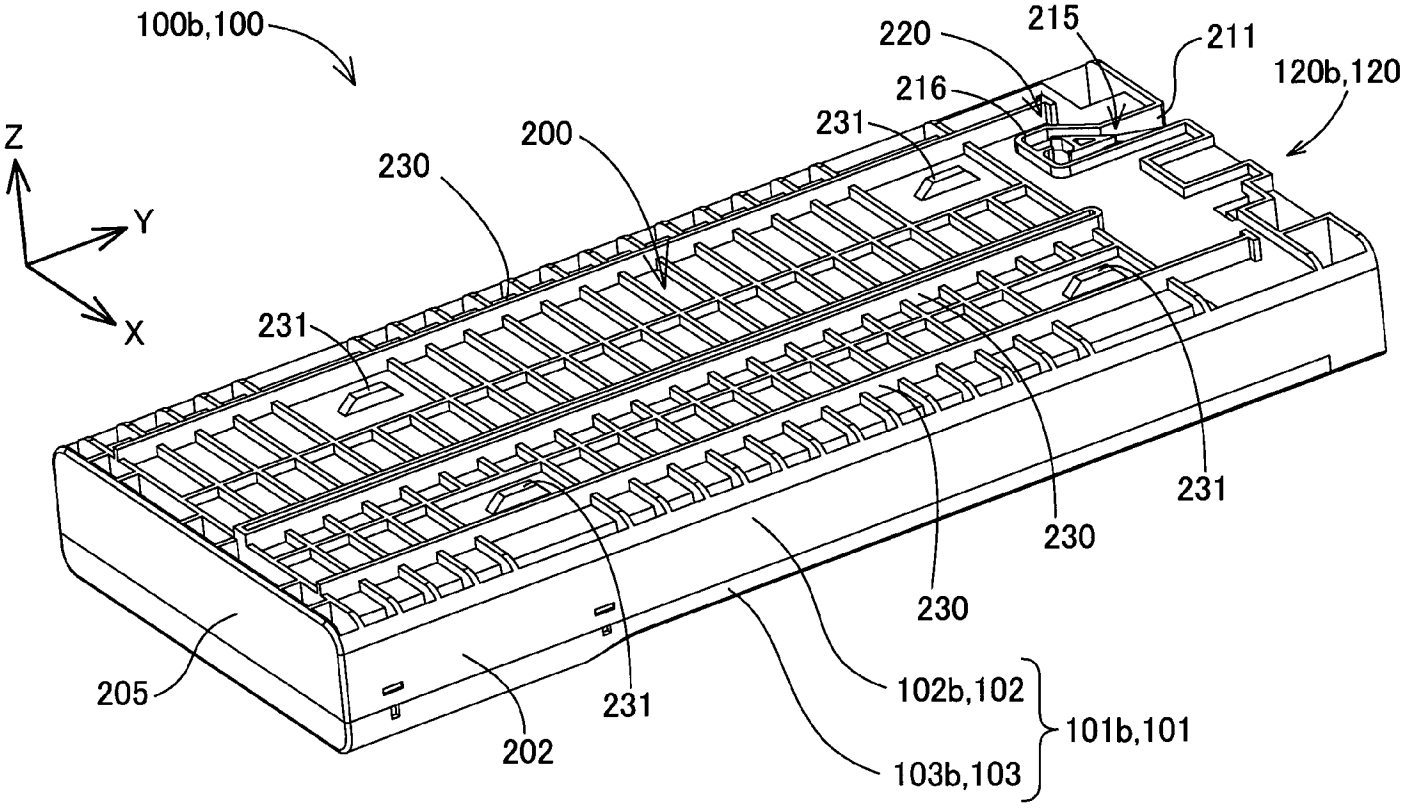
FIG. 14 is a schematic perspective view showing a configuration of a lower surface side of a bottom surface wall part of the second cartridge.

FIG. 11 is a schematic perspective view showing an upper surface side of the second cartridge 100*b*. FIG. 12 is a schematic view when the second cartridge 100*b* is viewed in the −Y direction. In the lower part of FIG. 12, for comparison, the first cartridge 100*a* when viewed in the same direction is shown in the same scale. FIG. 12 shows a center axis CL in the X directions in each of the first cartridge 100*a* and the second cartridge 100*b*, by a dot-and-dash line. FIG. 13 is a schematic view when the second cartridge 100*b* is viewed in the +Y direction. FIG. 14 is a schematic perspective view showing a configuration of a lower surface side of the second cartridge 100*b*.

As similar to the first cartridge 100*a*, the second cartridge 100*b* includes an accommodation part 110*b*, a second case 101*b* accommodating the accommodation part 110*b* in the inside, and a connection part 120*b* (shown in FIG. 11 to FIG. 14). The configuration of the second case 101*b* is the substantially same as the configuration of the first case 101*a*, except that the width in the X directions is larger than the first case 101*a* of the first cartridge 100*a*. The second case 101*b* has a tray 102*b* and a lid member 103*b*.

The accommodation part 110*b* of the second cartridge 100*b* has the almost same configuration as the accommodation part 110*a* of the first cartridge 100*a*, except that the width in the X directions is larger (see FIG. 11, FIG. 13). FIG. 11 and FIG. 13 show the accommodation part 110*b* schematically by a broken line, since the accommodation part 110*b* cannot be viewed from the outside of the second case 101*b*. The amount of liquid that can be accommodated by the accommodation part 110*b* of the second cartridge 100*b* is larger than that of the accommodation part 110*a* of the first cartridge 100*a*.

The connection part 120*b* of the second cartridge 100*b* includes similar component to the connection part 120*a* of the first cartridge 100*a*, as a component for connecting with the second connection receiving part 50*b* (see FIG. 11, FIG. 12). The connection part 120*b* has the liquid leading-out port 131, the cartridge side electrical connection part 140, the two receiving parts 150*a*, 150*b*, the fitting structure receiving part 155, and the inlet concave part 211.

The positions of the components described above of the connection part 120*b* with respect to the center axis CL are the almost same as those of the components of the connection part 120*a* of the first cartridge 100*a* (see FIG. 12). Since the connection part 120*b* of the second cartridge 100*b* has a small changing point with respect to the connection part 120*a* of the first cartridge 100*a*. Thus, common components can be used, and the manufacturing cost thereof can be reduced. In addition, the second connection receiving part 50*b* corresponding to the connection part 120*b* of the second cartridge 100*b* also can be configured to be almost similar to that of the first connection receiving part 50*a* corresponding to the connection part 120*a* of the first cartridge 100*a*. Thus, the manufacturing cost of the connection part 120 can be reduced.

In the description below, when the first case 101*a* of the first cartridge 100*a* and the second case 101*b* of the second cartridge 100*b* need not to be distinguished, the first case 101*a* and the second case 101*b* are collectively referred to as a "case 101". Similarly, the trays 102*a*, 102*b*, and the lid members 103*a*, 103*b* are collectively referred to as a "tray 102", and a "lid member 103", respectively. When the accommodation part 110*a* of the first cartridge 100*a* and the accommodation part 110*b* of the second cartridge 100*b* need not to be distinguished, the accommodation parts 110*a*, 110*b* are collectively referred to as a "accommodation part 110". When the connection part 120*a* of the first cartridge 100*a* and the connection part 120*b* of the second cartridge 100*b* need not to be distinguished, the connection parts 120*a*, 120*b* are collectively referred to as a "connection part 120".

Mounting Mechanism of Cartridge:

The mounting mechanism of the cartridge 100 to the connection receiving part 50 will be described with reference to FIG. 15. In an upper part of FIG. 15, the first cartridge 100*a* when viewed in the −Y direction is shown. In a lower part of FIG. 15, a part of the first connection receiving part 50*a* when viewed in the −Z direction is shown in correspondence to the first cartridge 100*a* of the upper part. The description below is common in mounting of the second cartridge 100*b* to the second connection receiving part 50*b*.

Moving the cartridge 100 in the +Y direction toward the arrangement region LA in the cartridge accommodation part 60 shown in FIG. 3, the pair of positioning parts 53*a*, 53*b* of the connection receiving part 50 are inserted firstly to the pair of receiving parts 150*a*, 150*b* of the cartridge 100, and the liquid leading-out port 131 of the cartridge 100 is positioned.

Then, the liquid leading-in part 51 of the connection receiving part 50 is inserted to the liquid leading-out port 131 of the cartridge 100, and the liquid leading-out port 131 of the cartridge 100 and the liquid leading-in part 51 of the connection receiving part 50 is connected. Before the connection between the liquid leading-out port 131 and the liquid leading-in part 51 is completely finished, the circumferential edge rib 133 provided in the circumference of the liquid leading-out port 131 contacts with the base end member 57 being in the circumference of the liquid leading-in part 51. Pushing the cartridge 100 in the +Y direction until the liquid leading-out port 131 and the liquid leading-in part 51 are connected, the base end member 57 displaces in the +Y direction. The cartridge 100 is energized in the −Y direction by an energizing member (not shown in figures) provided inside the base end member 57.

Concurrently with the connection between the liquid leading-out port 131 and the liquid leading-in part 51 described above, the device side electrical connection part 52 of the connection receiving part 50 is inserted to the substrate arrangement part 144 of the cartridge 100, and electrically contacts with the substrate 141 of the cartridge side electrical connection part 140. When the connection between the liquid leading-out port 131 and the liquid leading-in part 51 is finished, the electrical connection between the cartridge side electrical connection part 140 and the device side electrical connection part 52 is established.

Before the pair of positioning parts 53*a*, 53*b* are inserted to the pair of receiving parts 150*a*, 150*b*, the device side fixation structure 54 of the connection receiving part 50 is inserted to the inlet concave part 211 composing the inlet of the groove portion 215 provided in the bottom surface wall part 200 of the case 101. When the connection between the liquid leading-out port 131 and the liquid leading-in part 51 is finished, the projection portion 54*p* of the device side fixation structure 54 engages with the engaged part of the cartridge side fixation structure 220 (shown in FIG. 8, FIG. 14) provided in the case 101 of the cartridge 100, by engagement mechanism described later. The state where the position of the cartridge 100 is fixed to the predetermined arrangement region LA (shown in FIG. 3) by this engagement is the "mounting state where the cartridge 100 is mounted to the cartridge accommodation part 60".

In the cartridge 100 of the present embodiment, the cartridge side electrical connection part 140 is located between the liquid leading-out port 131 and the first receiving part 150*a* in the X directions. Therefore, the positioning accuracy in the X directions of the cartridge side electrical connection part 140 with respect to the device side electrical connection part 52 and the positioning accuracy of the liquid leading-out port 131 are enhanced, by the pair of positioning parts 53*a*, 53*b* and the pair of receiving parts 150*a*, 150*b*.

In the cartridge 100 of the present embodiment, the cartridge side fixation structure 220 is located between the liquid leading-out port 131 and the first receiving part 150*a* in the X directions, when viewed in the Y directions. Thus, the movement in the Y directions of the device side fixation structure 54 after the device side fixation structure 54 is inserted to the groove portion 215 is guided by the pair of positioning parts 53*a*, 53*b*, and the pair of receiving parts 150*a*, 150*b*. Thereby, the positioning accuracy of the device side fixation structure 54 with respect to the cartridge side fixation structure 220 is enhanced.

In addition, in the cartridge 100 of the present embodiment, the cartridge side electrical connection part 140 and the cartridge side fixation structure 220 are provided between the liquid leading-out port 131 and the first receiving part 150*a*. Therefore, for the amount, the distance in the X direction between the pair of receiving parts 150*a*, 150*b* becomes large, and the positioning accuracy described above by the pair of positioning parts 53*a*, 53*b* and the pair of receiving parts 150*a*, 150*b* are further enhanced.

As described above, in the cartridge 100 of the present embodiment, the opening shapes are different between the first opening part 151*a* of the first receiving part 150*a* and the second opening part 151*b* of the second receiving part 150*b*. An opening width W2 in the X directions of the second opening part 151*b* is larger than an opening width W1 in the X directions of the first opening part 151*a*. By this configuration, an angle of the second positioning part 53*b* with respect to the Y directions in the horizontal direction when the second positioning part 53*b* is inserted to the second receiving part 150*b* can have extra margin. Therefore, connection operation of the cartridge 100 to the connection receiving part 50 is simplified. With such margin being provided, when the cartridge 100 is connected to the connection receiving part 50, a stress generated when the second positioning part 53*b* is inserted to the second receiving part 150*b* is decreased. In the present embodiment, the opening width in the Z directions of the first opening part 151*a* and that of the second opening part 151*b* are almost equal. However, the opening width of the first opening part 151*a* in the Z directions and that of the second opening part 151*b* may be different.

Figure 16A:
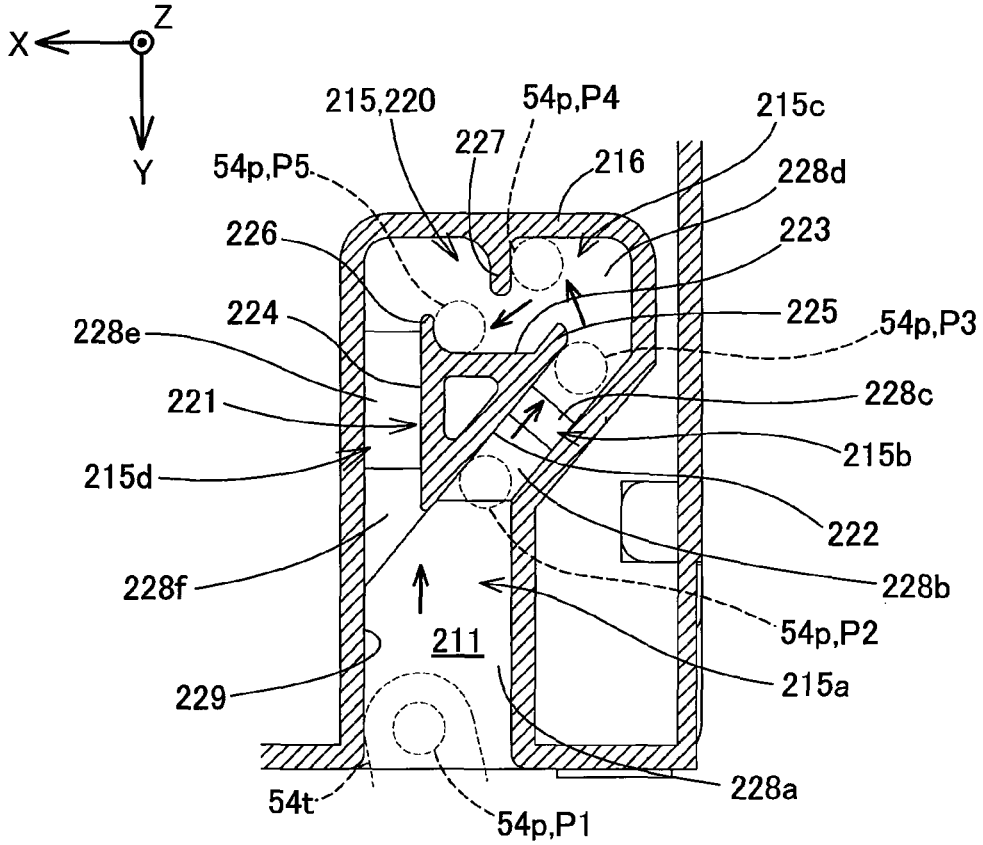
FIG. 16A is a first schematic view for explaining a mechanism until engagement of an engaging part to an engaged part is finished.
Figure 16B:
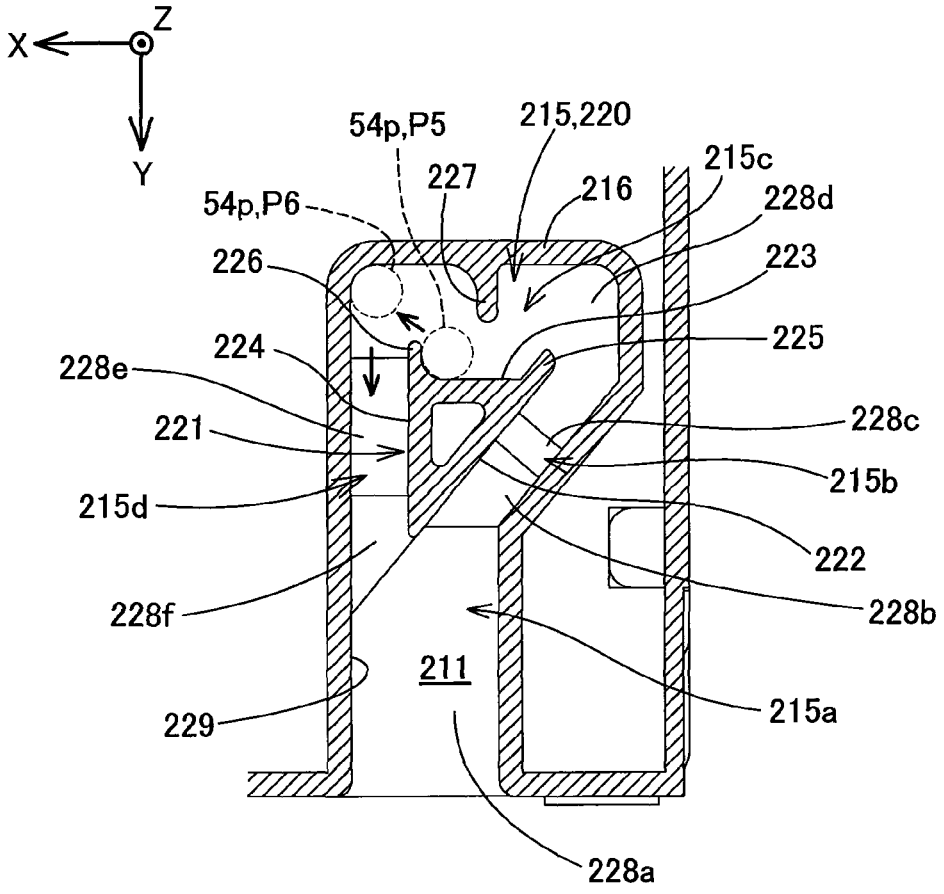
FIG. 16B is a second schematic view for explaining a mechanism in a phase an engagement state between the engaging parts is released.

Engagement Mechanism of Device Side Fixation Structure to Cartridge Fixation Structure:

Referring to FIG. 16A and FIG. 16B, the engagement mechanism of the device side fixation structure 54 to the cartridge side fixation structure 220 will be described. FIG. 16A and FIG. 16B show the cartridge side fixation structure 220 when viewed in the −Z direction. In FIG. 16A and FIG. 16B, in order to show a movement locus of the projection portion 54*p* of the device side fixation structure 54 in the groove part 215, positions P1 to P6 of the projection portion 54*p* at different timings are shown by broken lines.

First, referring to FIG. 16A, the configuration of the cartridge side fixation structure 220 will be described. The cartridge side fixation structure 220 has a center convex portion 221 that projects in the +Z direction, in a center of a region that is deep in the −Y direction side further from the inlet concave portion 211 that is located in the end portion of the +Y direction side. An outer circumferential wall surface of the center convex portion 221 when viewed in the Z directions composes an outer circumferential contour line having a substantially triangle shape. The inside of the center convex part 221 is hollowed.

The outer circumferential wall surface of the center convex portion 221 includes a first wall surface 222, a second wall surface 223, and a third wall surface 224. The first wall surface 222 extends in a diagonal direction between the X directions and the Y directions. At least a part of the first wall surface 222 overlaps with the inlet concave portion 211 in the Y directions. The second wall surface 223 extends in the X directions and crosses with the first wall surface 222. The third wall surface 224 extends in the Y directions and crosses with the first wall surface 222 and the second wall surface 223. The third wall surface 224 overlaps with the inlet concave portion 211 in the Y directions.

The center convex portion 221 has a first projection wall part 225 and a second projection wall part 226. The first projection wall part 225 slightly extends out from the second wall surface 223 in the −Y direction side from the second wall surface 223 along a direction in which the first wall surface 222 extends, in the end portion of the −X direction side of the second wall surface 223. The second projection wall part 226 is a wall part that functions as an engaged part. Hereinafter, the second projection wall part 226 may be referred to as an engaged part 226. The second projection wall part 226 slightly extends out from the second wall surface 223 in the −Y direction side along a direction in which the third wall surface 224 extends, in the end portion of the +X direction side of the second wall surface 223.

The cartridge side fixation structure 220 further has a third projection wall part 227. The third projection wall part 227 is formed as a part of the rib 216. The third projection wall part 227 projects in the +Y direction from the rib 216 to the second wall surface 223, in a position facing the second wall surface 223 of the center convex portion 221 in the Y directions.

For convenience of description, the groove portion 215 is divided into a first groove portion 215*a*, a second groove portion 215*b*, a third groove portion 215*c*, and a fourth groove portion 215*d*. The first groove portion 215*a* is a portion formed by the inlet concave portion 211 and extending in the Y direction. The second groove portion 215*b* is a portion facing to the first wall surface 222 and extending in the diagonal direction between the X directions and the Y directions. The third groove portion 215*c* is a portion including a portion facing to the second wall surface 223, and formed so as to meander in substantially zig-zag in the X directions by the three projection wall parts 225 to 227. The fourth groove portion 215*d* is a portion facing to the third wall surface 224 and extending in the +Y direction toward the first groove portion 215*a*.

A first bottom surface 228*a* that is a bottom surface of the first groove portion 215*a* composes an inclined surface gradually ascending in the +Z direction gradually toward −Y direction. A second bottom surface 228*b* that is a bottom surface of a portion coupled to the first groove portion 215*a*, of the second groove portion 215*b* composes a horizontal surface that is substantially horizontal. A third bottom surface 228*c* located in approximately at the center of the second groove portion 215*b* composes an inclined surface descending from the second bottom surface 228*b* in the −Z direction. A fourth bottom surface 228*d* including a bottom surface of the end portion of the −Y direction side of the second groove portion 215*b* and a bottom surface of the third groove portion 215*c* compose a horizontal surface that is substantially horizontal. A fifth bottom surface 228*e* that is a bottom surface of the fourth groove portion 215*d* composes an inclined surface ascending from the fourth bottom surface 228*d* in the +Z direction, as a position becomes further in the +Y direction side. A sixth bottom surface 228*f* that is a bottom surface between the first bottom surface 228*a* and the fifth bottom surface 228*e* composes a horizontal surface that is substantially horizontal.

Referring to FIG. 16A, the mechanism until engagement between the second projection wall part 226 (engaged part 226) of the cartridge side fixation structure 220 and the projection portion 54*p* (engaging part) of the device side fixation structure 54 is finished will be described. When the cartridge 100 (FIG. 6) is inserted to the cartridge accommodation part 60 toward the +Y direction, and the tip end surface 121 (FIG. 6) of the cartridge 100 reaches the position over the tip end portion 54*t* of the device side fixation structure 54 (FIG. 5), the tip end portion 54*t* of the device side fixation structure 54 is inserted in the −Y direction to the first groove portion 215*a*. At this time, the end surface of the +X direction side of the tip end portion 54*t* contacts with a side wall surface 229 of the +X direction side of the first groove portion 215*a*, and the projection portion 54*p* of the device side fixation structure 54 is located in an apart position from the side wall surface 229 (P1). At this time, since the end surface of the tip end portion 54*t* is pushed in the −X direction by the side wall surface 229, the device side fixation structure 54 is in a further rotated state in the −X direction side than when the external force to the horizontal direction is not applied. When the cartridge 100 is inserted further in the +Y direction, the projection portion 54*p* of the device side fixation structure 54 moves from the position P1 in the −Y direction, In this process of moving, the projection portion 54*p* of the device side fixation structure 54 contacts with the first bottom surface 228*a* that is an inclined surface, to be pushed in the +Z direction by the first bottom surface 228*a*.

Pushing the cartridge 100 further in the +Y direction, the projection portion 54*p* of the device side fixation structure 54 is pushed in the +Z direction by the first bottom surface 228*a*, and the tip end portion 54*t* of the device side fixation structure 54 is located further in the +Z direction side than the end surface of the +Z direction side of the rib 216, to be spaced apart from the rib 216. Then, the projection portion 54*p* of the device side fixation structure 54 contacts with the first wall surface 222, and runs on the horizontal second bottom surface 228*b* (position P2).

The projection portion 54*p* of the device side fixation structure 54 moves in the −Y direction side along the first wall surface 222, while being pushed in the −X direction side by the first wall surface 222, descends the third bottom surface 228*c*, reaches the horizontal fourth bottom surface 228*d*, and reaches a position of contacting with the first projection wall part 225 (position P3). After that, the projection portion 54*p* of the device side fixation structure 54 moves further to the −Y direction side, to release the contact state with the first projection wall part 225. Then, the projection portion 54*p* moves instantaneously to the +X direction side by an energizing force imparted toward the +X direction side to the device side fixation structure 54, to collide with the third projection wall part 227 (position P4). By this collision, a click sound is generated.

Figure 15:
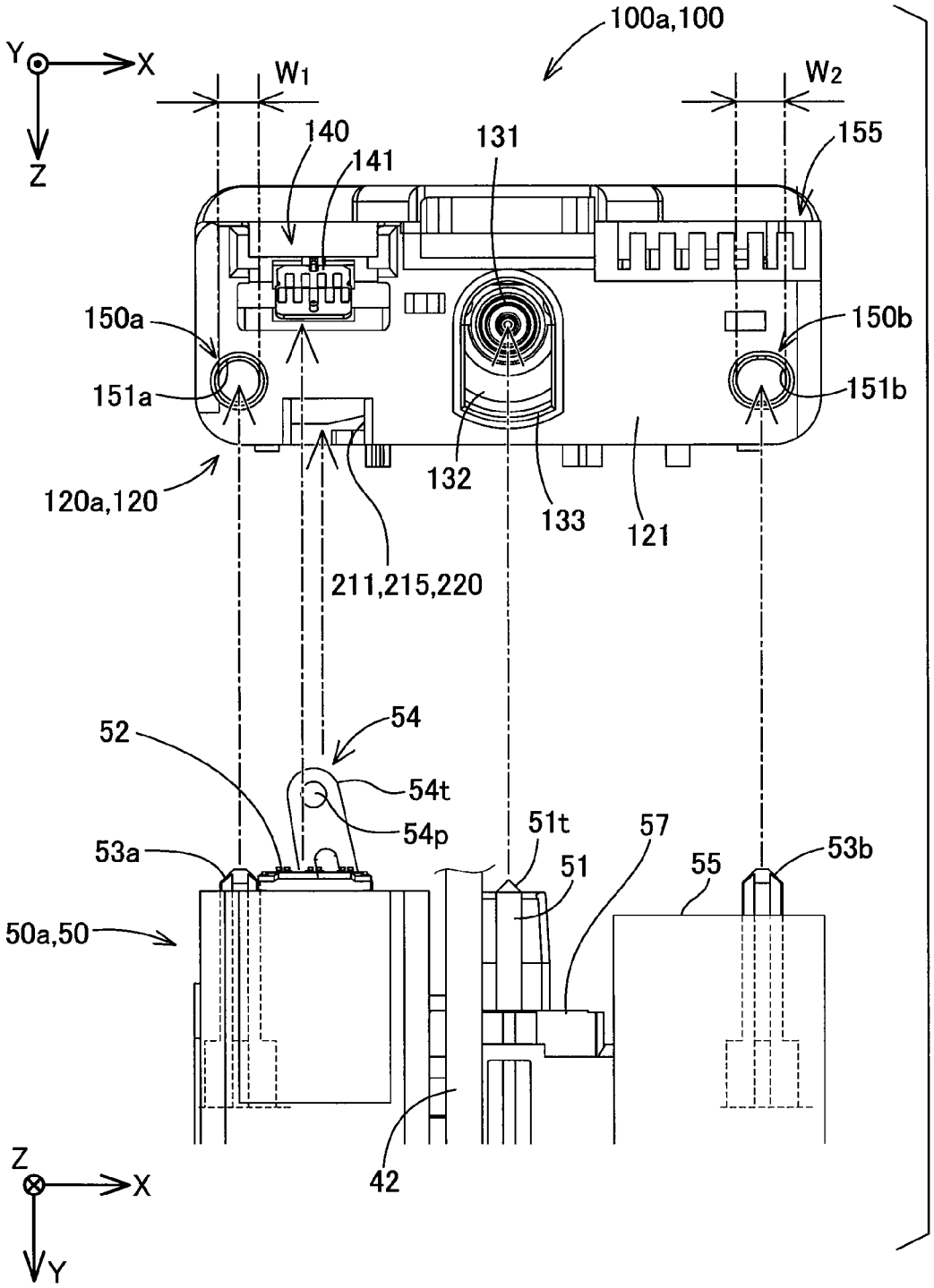
FIG. 15 is a schematic view for explaining a mounting mechanism of the cartridge to the connection receiving part.

Releasing the force imparted in the +Y direction to the cartridge 100 by the user in response to the click sound, the cartridge 100 slightly moves in the −Y direction by an energizing force in the −Y direction by the base end member 57 shown in FIG. 15. Thereby, the projection portion 54*p* of the device side fixation structure 54 moves in the +Y direction along the third projection wall part 227 to release the contact state of the projection portion 54*p* to the third projection wall part 227. Then, the projection portion 54*p* moves instantaneously to the +X direction side by an energizing force imparted toward the +X direction side to the device side fixation structure 54, to collide with and be received by the second wall surface 223 and the second projection wall part 226 (position P5).

In this way, in the position P5, the projection portion 54*p* of the device side fixation structure 54 is engaged with the second projection wall part 226 of the cartridge side fixation structure 220, and the second projection wall part 226 of the cartridge side fixation structure 220 and the projection portion 54*p* of the device side fixation structure 54 are engaged. Hereinafter, the second projection wall part 226 may be referred to as a "engaging part 226", in addition to the "engaged part 226". The engagement of the second projection wall part 226 of the cartridge side fixation structure 220 and the projection portion 54*p* of the device side fixation structure 54 restricts the cartridge 100 moving in the −Y direction, and then the cartridge 100 is in the mounting state in which the cartridge 100 is mounted to the cartridge accommodation part 60. In this state, the projection portion 54*p* of the device side fixation structure 54 contacts with the fourth bottom surface 228*d*. As described above, the device side fixation structure 54 is energized in the −Z direction by the elastic member (not shown in figures) arranged inside the connection receiving part 50, and elastically rotates in the +Z direction when receiving an external force in the +Z direction. The energizing force in the −Z direction is transferred to the fourth bottom surface 228*d* (shown in FIG. 16A) through the projection portion 54*p*. That is, in the mounting state where the cartridge 100 is mounted to the cartridge accommodation part 60, the projection part 54*p* is in a state where force is imparted in the −Z direction to the case 101 of the cartridge 100.

In the state where the engaged part 226 of the cartridge side fixation structure 220 and the engaging part 54*p* of the device side fixation structure 54 engage with each other, the cartridge side electrical connection part 140 is electrically connected to the device side electrical connection part 52, and receives at least a force in the +Z direction from the device side electrical connection part 52. As described above, in the cartridge 100 of the present embodiment, the cartridge side fixation structure 220 and the cartridge side electrical connection part 140 are in a positional relation of overlapping with each other in at least a part, when viewed in the Z directions (see FIG. 12). Therefore, at least a part of the force of the +Z direction received by the cartridge side electrical connection part 140 from the device side electrical connection part 52 is cancelled by the force received by the cartridge 100 in the −Z direction from the projection portion 54*p*. Accordingly, the component in the Z directions of the force received by the cartridge 100 in the +Y direction side is decreased, and the arrangement posture in the Z directions of the cartridge 100 is prevented from shifting from an assumed proper posture. Thus, the arrangement posture of the cartridge 100 with respect to the connection receiving part 50 is prevented from degrading, and the connection state thereof is improved. In addition, it is prevented that, according to degradation of the arrangement posture of the cartridge 100, unnecessary stress is generated in the connection portion between the connection receiving part 50 and the cartridge 100. Thus, the various components described above for connecting the connection receiving part 50 and the cartridge 100 are prevented from being damaged and degraded.

Referring to FIG. 16B, the mechanism in a phase that the engagement state of the cartridge side fixation structure 220 and the device side fixation structure 54 is released will be described. In the liquid ejection device 10 of the present embodiment, as described below, the cartridge side fixation structure 220 and the device side fixation structure 54 are configured so as to release the engagement state when the cartridge 100 is pushed in the +Y direction by the user. When the user pushes the front surface wall part 205 (shown in FIG. 2) of the case 101 to push the cartridge 100 in the +Y direction, the projection portion 54*p* of the device side fixation structure 54 moves from the position P5 in the −Y direction, and is released from a state of engaging with the second projection wall part 226 in the +X direction. Therefore, by the energizing force imparted to the device side fixation structure 54 toward the +X direction side by the energizing member, the projection portion 54*p* instantaneously moves to the +X direction side to collide with the side wall surface 229 of the +X direction side of the rib 216 (position P6).

Thereby, since the projection portion 54 is located in the fourth groove portion 215*d*, the movement in the +Y direction is allowed. That is, the engagement state of the cartridge side fixation structure 220 and the device side fixation structure 54 is released. By the click sound generated by collision of the projection portion 54*p* with the rib 216, described above, the user can know that the engagement state of the cartridge side fixation structure 220 and the device side fixation structure 54 is released. When the movement in the +Y direction of the projection portion 54*p* is allowed, by the force imparted in the −Y direction by the base end member 57 (shown in FIG. 15), the cartridge 100 automatically moves in the −Y direction. After the base end member 57 is separated from the connection receiving part 50, the user can draw and take out the cartridge 100. As is known from description above, the groove portion 215 composes a loop-shaped guiding path that guides the projection portion 54*p*. An inlet portion and an outlet portion of the guiding path is common. The guiding path is composed of the engaging part 226, an inlet side guiding path, and an outlet side guiding path. The inlet side guiding path is a path portion from the inlet portion described above to the engaging part 226. The outlet side guiding path is a path portion from the engaging part 226 to the outlet portion described above.

A3. Conclusion of First Embodiment:

As described above, according to the cartridge 100 of the present embodiment, in a state where the cartridge 100 is mounted to the liquid ejection device 10, at least a part of the force in the Z directions received by the cartridge side electrical connection portion 140 from the device side electrical connection portion 52 is decreased by the force received by the case 101 of the cartridge 100 from the projection portion 54*p* of the device side fixation structure 54, that is, the force received from the engaging part 54*p*. Accordingly, the arrangement posture of the cartridge 100 is prevented from shifting to the Z directions from the proper posture. The width in the Z directions of the cartridge 100 is smaller than the width in the X direction and the width in the Y directions of the cartridge 100. Therefore, the arrangement posture of the cartridge 100 in the state of being mounted to the liquid ejection device 10 becomes stable, and the connection state of the cartridge 100 to the liquid ejection device is improved. In addition, the cartridge 100 in which the case 101, the accommodation part 110, and the connection part 120 are integrated can exhibit various operation and effects described above for the embodiment, such as improvement of the connectivity to the liquid ejection device 10, simplification of the configuration, and improvement of durability. Such operation and effect can be acquired similarly in the liquid ejection system 11 in which the cartridge 100 is mounted to the liquid ejection device 10.

B. Second Embodiment

Figure 17:
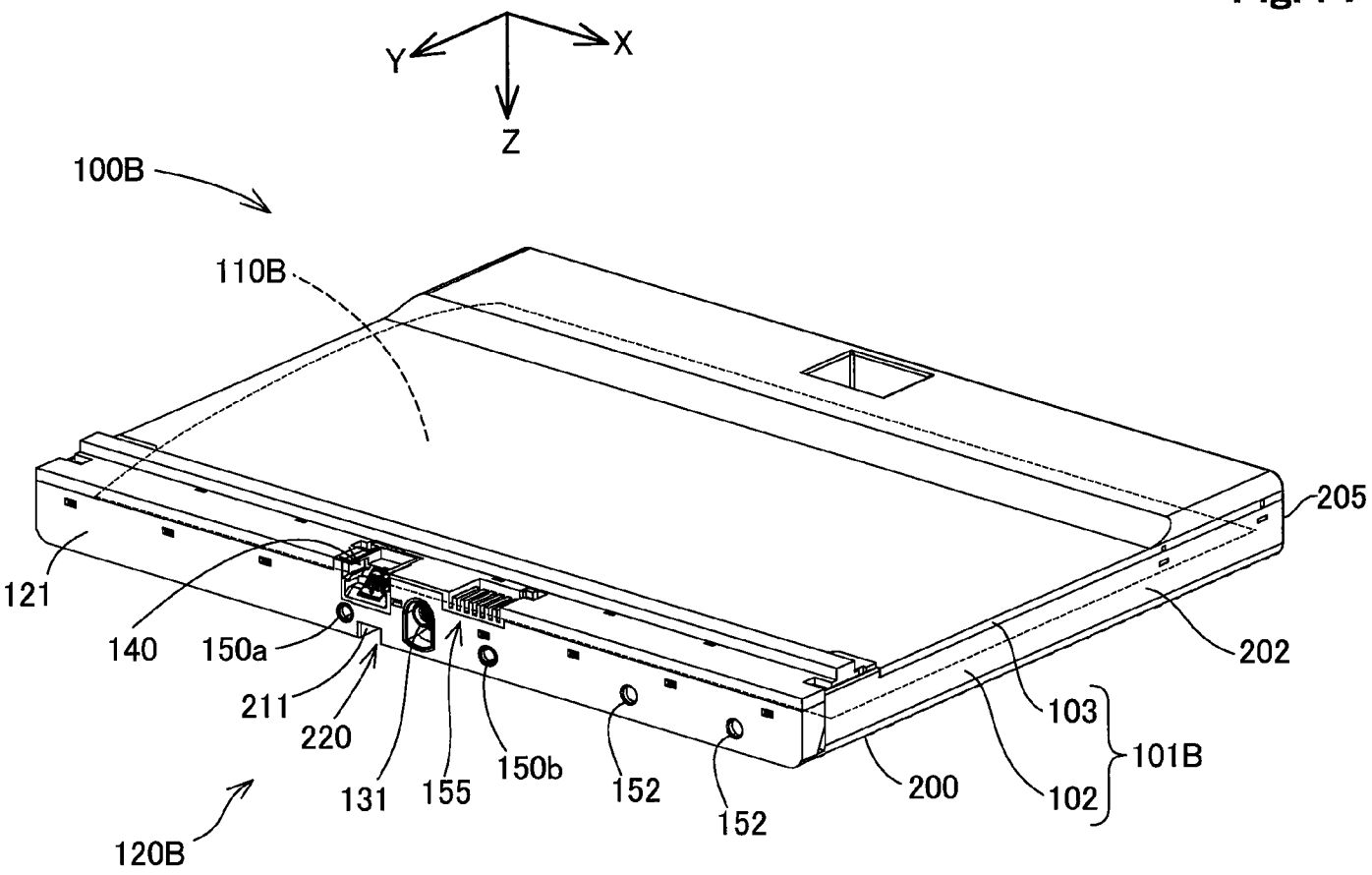
FIG. 17 is a schematic perspective view showing a configuration of a cartridge of a second embodiment.
Figure 18:
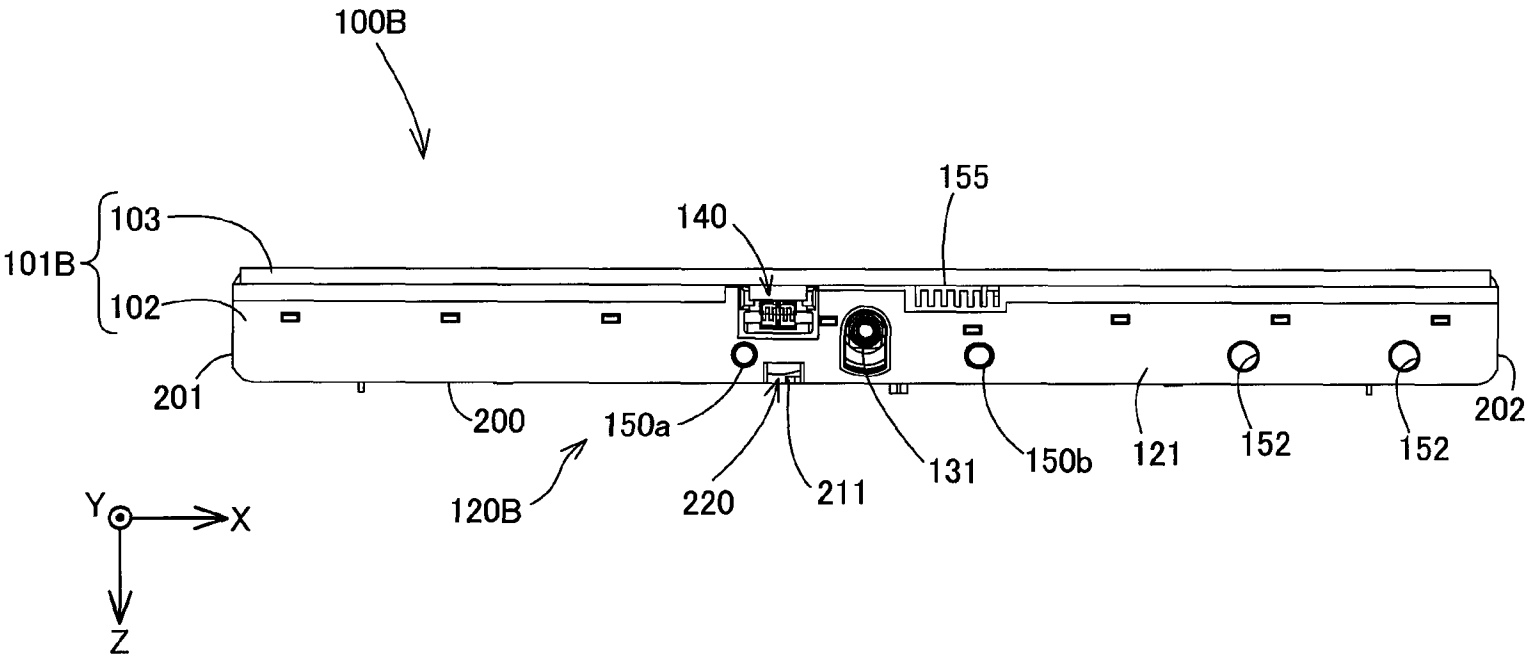
FIG. 18 is a schematic view showing the configuration of the cartridge of the second embodiment.

The configuration of the cartridge 100B in the second embodiment will be described with reference to FIG. 17 and FIG. 18. FIG. 17 is a schematic perspective view showing an upper surface side of the cartridge 100B of the second embodiment. FIG. 18 is a schematic view when the cartridge 100B of the second embodiment is viewed in the −Y direction. The configuration of the cartridge 100B of the second embodiment is almost the same as the configuration of the cartridge 100 of the first embodiment.

The liquid ejection device mounted with the cartridge 100B of the second embodiment is almost the same as the liquid ejection device 10 (sown in FIG. 1 to FIG. 5) described for the first embodiment, except that the liquid ejection device is an inkjet printer that performs monochromatic printing. In the liquid ejection device of the second embodiment, almost the entire region of the cartridge accommodation part 60 is dominated by one cartridge 100B. The connection receiving part 50 is installed by one in approximately at the center in the X directions, in the region of the +Y direction side of the cartridge accommodation part 60.

The width in the X directions of the cartridge 100B of the second embodiment and the case 101B thereof, is extended further than the cartridge 100 of the first embodiment, and is larger than the width in the Y directions. Width in the X directions of the accommodation part 110B provided inside the case 101B is also extended according to the case 101B. Thereby, the liquid amount that can be accommodated in the cartridge 100B of the second embodiment is larger than that of the cartridge 100 of the first embodiment. The connection part 120B of the cartridge 100B is configured so as to connect with the connection receiving part 50 having the same configuration as that described in the first embodiment. Thus, in the connection part 120B, the arrangement layout of the liquid leading-out port 131, the cartridge side electrical connection part 140, the first receiving part 150*a*, the second receiving part 150*b*, the fitting structure receiving part 155, and the inlet concave portion 211 that are components for connection with the connection receiving part 50, is almost the same as that of the connection part 120 of the first embodiment (see FIG. 18).

A lower surface of the cartridge 100B is provided with the cartridge side fixation structure 220 composed of the groove portion 215, in the similar position to that of the cartridge 100 of the first embodiment. In the tip end surface 121 facing in the +Y direction included in the connection part 120B of the cartridge 100B, an opening part 152 that opens in the +Y direction is provided, in addition to the first receiving part 150*a* and the second receiving part 150*b*. The opening part 152 is provided in order to accommodate in the inside a structure (not shown in figures) projecting in the −Y direction toward the tip end surface 121 in the cartridge accommodation part 60, and prevent contact between the structure and the cartridge 100B. In the second embodiment, the opening part 152 has a substantially circle-shaped opening shape, and is arrayed in plural in the X directions. Each of the opening parts 152 accommodates one structure described above of the cartridge accommodation part 60.

According to the cartridge 100B of the second embodiment, the liquid accommodation amount can be increased. Since the width in the X directions is enlarged, the stability of the arrangement posture of the cartridge 100B in the liquid ejection device is improved. In addition, according to the cartridge 100B of the second embodiment and the liquid ejection system in which the cartridge 100B is mounted to the liquid ejection device, various operation and effects described for the first embodiment can be exhibited.

C. Third Embodiment

Figure 19:
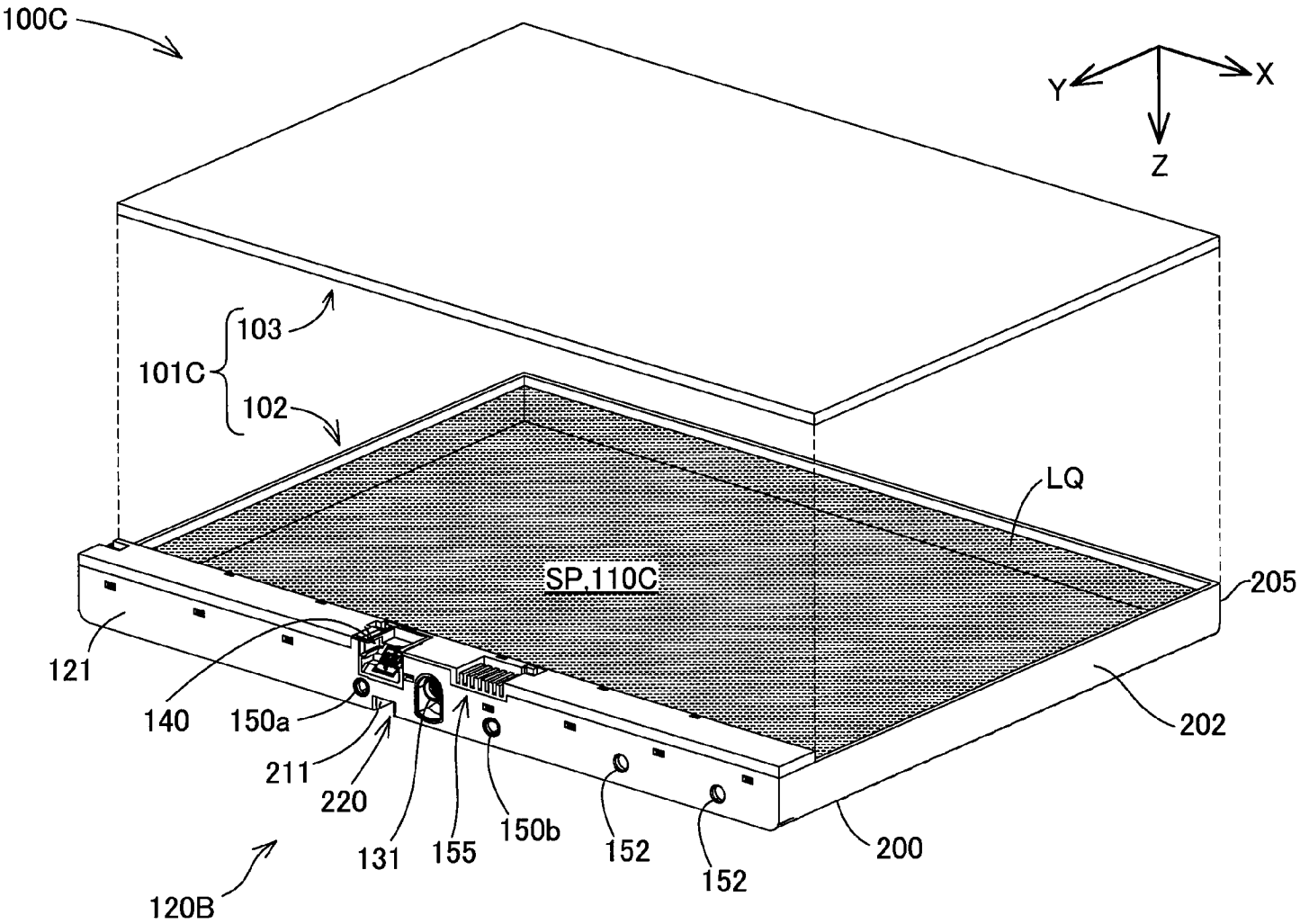
FIG. 19 is a schematic exploded perspective view showing a configuration of a cartridge of a third embodiment.

FIG. 19 is an exploded perspective view showing the configuration of a cartridge 100C in the third embodiment. FIG. 19 shows a state where the lid member 103 is detached from the tray 102 of the cartridge 100C. The cartridge 100C of the third embodiment is substantially the same as the configuration of the cartridge 100B of the second embodiment, except that an accommodation part 110C having a different configuration is provided instead of the accommodation part 110 described for the first embodiment, in the inside of the case 101C.

The accommodation part 110C of the cartridge 100C is not composed of a bag-shaped member having flexibility, and has a configuration in which liquid LQ is directly accommodated in an internal space SP of the case 101C that is formed when the opening part of the tray 102 is sealed by the lid member 103. In a boundary between the tray 102 and the lid member 103, a seal part for preventing leakage of the liquid LQ from the internal space SP (not shown in figures). The lid member 103 is provided with an atmospheric open port (not shown in figures) for leading air into the internal space SP according to consumption of the liquid LQ. The internal space SP may be arranged with a liquid holding member that absorbs and holds the liquid LQ to the inside, and a piping member that communicates the liquid leading-out port 131 and the internal space SP.

According to the cartridge 100C of the third embodiment, since the overall the case 101C can be utilized as the accommodation part 110C, the amount of the liquid LQ that can be accommodated can be further increased than the cartridge 100B of the second embodiment. In addition, according to the cartridge 100C of the third embodiment, the various operation and effects described for the first embodiment and the second embodiment can be exhibited.

D. Fourth Embodiment

Figure 20:
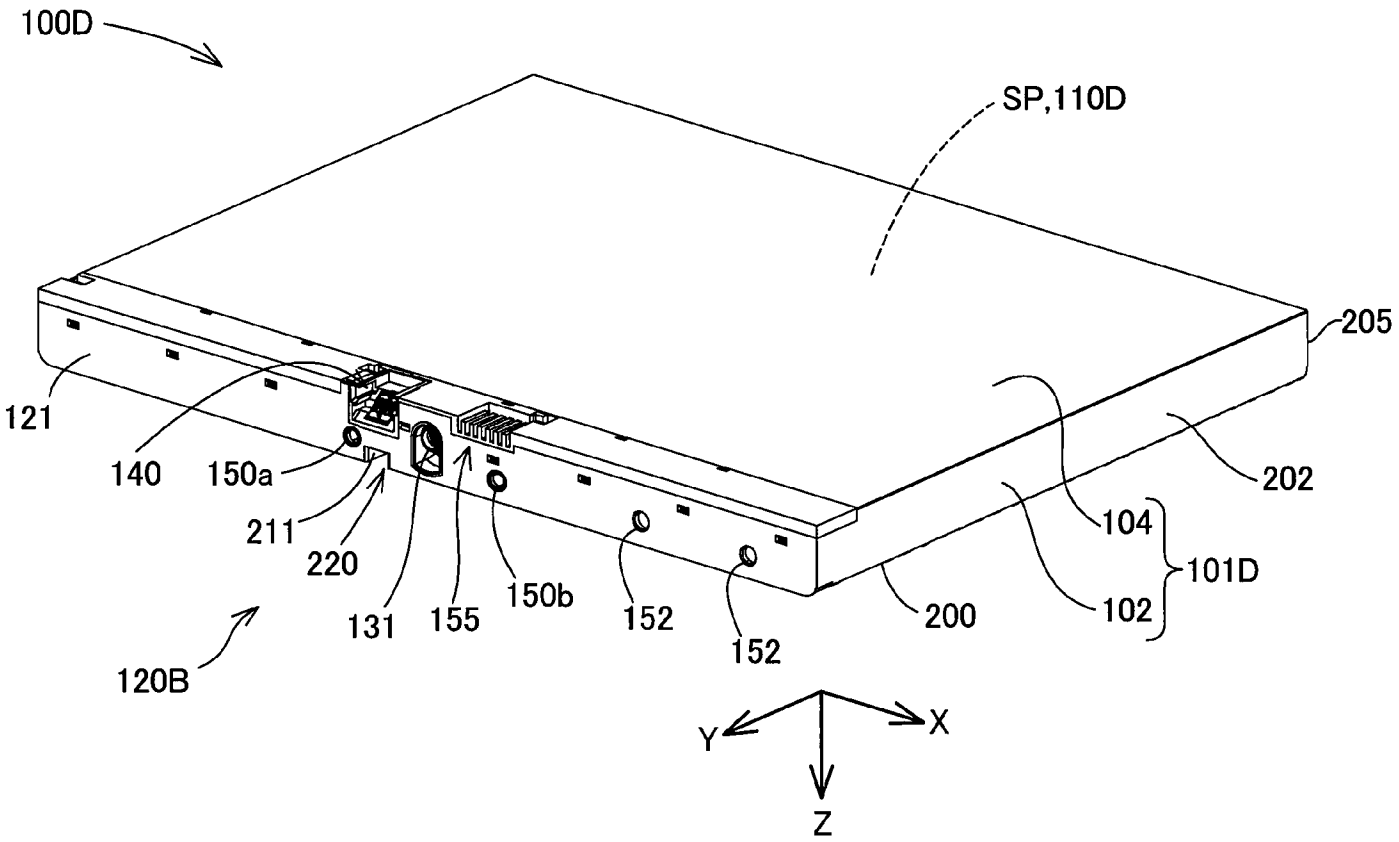
FIG. 20 is a schematic perspective view showing a cartridge of a fourth embodiment.

FIG. 20 is a schematic perspective view showing the configuration of a cartridge 100D of the fourth embodiment. The cartridge 100D of the fourth embodiment is almost the same as the configuration of the cartridge 100C of the fourth embodiment, except that the opening part of the tray 103 is sealed by a film member 104, instead of the lid member 103.

The cartridge 100D includes a case 101D in which the film member 104 is welded in the opening part of the tray 102. In the inside of the case 101D, the internal space SP air-tightly sealed is formed in the cartridge 100. The internal space SP of the case 101D composes the accommodation part 110D in which the liquid is directly accommodated. The film member 104 has flexibility, and deflects to the internal space SP side when a negative pressure is generated in the internal space SP, according to consumption of the liquid in the accommodation part 110D.

According to the cartridge 100D of the fourth embodiment, the tray 102 and the film member 104 compose the case 101. Thus, the components of the case 101 can be simplified and lightened in weight, and the manufacturing cost of the cartridge 100D can be decreased. In addition, the various operation and effect described in the embodiments described above can be exhibited.

E. Fifth Embodiment

Figure 21:
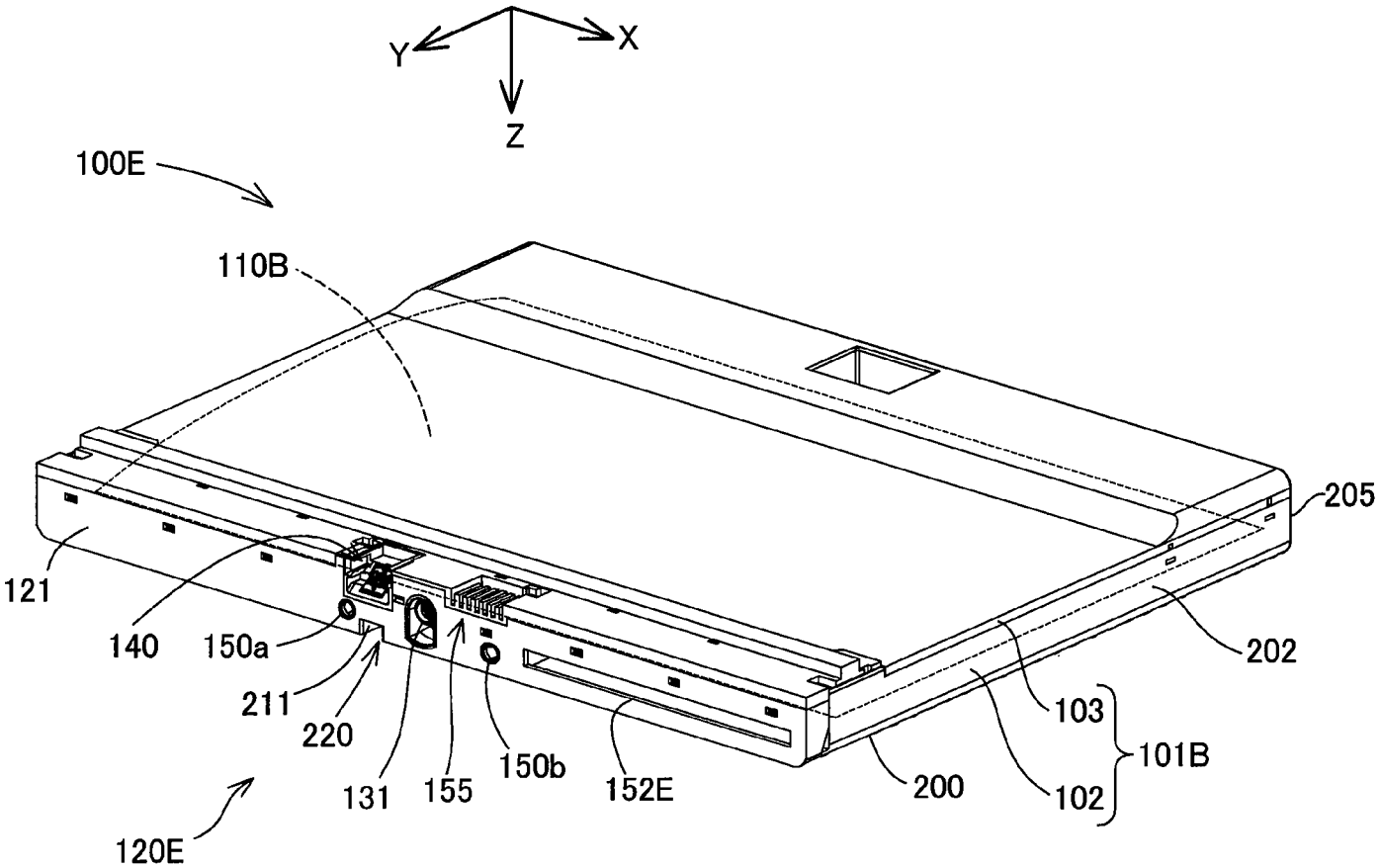
FIG. 21 is a schematic perspective view showing a cartridge of a fifth embodiment.

FIG. 21 is a schematic perspective view showing the configuration of a cartridge 100E in a fifth embodiment. The configuration of the cartridge 100E of the fifth embodiment is substantially the same as the configuration of the cartridge 100B of the second embodiment, except that the cartridge 100E has an opening part 152E, instead of the opening part 152. The opening part 152E opens in the +Y direction in the tip end surface 121 of the connection part 120E. The opening part 152E has a substantially rectangular opening shape with the longitudinal direction as the X directions. The opening part 152E is formed in from a position that is close to the center of the cartridge 100E in the X directions, to a position that is close to the end portion in the X directions. When the cartridge 100E is mounted to the liquid ejection device, the opening part 152E accommodates a plurality of structures (not shown in figures) arrayed and provided in the X directions in the cartridge accommodation part 60 shown in FIG. 3 and each projecting in the −Y direction. According to the cartridge 100E of the fifth embodiment, when the cartridge 100E is mounted to the liquid ejection device, contact of the cartridge accommodation part 60 with the structure described above can be prevented. In addition, according to the cartridge 100E of the fifth embodiment, the various operation and effects described above for the embodiments can be exhibited.

F. Modification of Embodiments

Modified modes of the configuration of the embodiments described above will be described as modifications. Each of the modifications described below is considered as an example of the embodiments for performing the disclosure. In the description below, when the embodiments referred to need not to be distinguished, the alphabet added in the end of the numeral of the components will be omitted.

F1. Modification 1:

In the embodiments described above, the Y directions that is the moving direction of the cartridge 100 (case 101) in the cartridge accommodation part 60 is the same direction as a front and back direction of the liquid ejection device 10. On the other hand, the Y direction that is the moving direction of the cartridge 100 in the cartridge accommodation part 60 may not be the same as the front and back direction of the liquid ejection device 10. The Y directions that are the moving direction of the cartridge 100 in the cartridge accommodation part 60 may be a horizontal direction of the liquid ejection device 10. That is, the mounting port of the cartridge 100 may be provided in a side surface of the right side or the left side of the liquid ejection device 10. In the embodiments described above, the cartridge accommodation part 60 is provided in a position of the lowermost stage in the liquid ejection device 10. On the other hand, the cartridge accommodation part 60 may be formed in the other height positions. The cartridge accommodation part 60 may be provided in the center part in the Z directions.

F2. Modification 2:

The liquid ejection device 10 of the first embodiment is mounted with four cartridges 100, and the liquid ejection devices of the second embodiment, the third embodiment, the fourth embodiment, and the fifth embodiment are mounted with one cartridge 100B, 100C, 100D, or 100E. The number of the cartridges 100 mounted to the liquid ejection device is not limited to the number in the embodiments described above. For example, the liquid ejection device may be configured so as to be mounted with only one of the first cartridge 100*a* and the second cartridge 100*b*, and the liquid ejection device may be configured so as to accommodate two or more of the cartridges 100B of the second embodiment. In addition, in the first embodiment described above, the liquid ejection device 10 is mounted with two types of cartridges 100*a*, 100*b*. On the other hand, the liquid ejection device 10 may be mounted with three or more types of cartridges having difference configuration. In addition, the liquid ejection device mounted with the cartridge 100B of the second embodiment may have a configuration in which the plurality of cartridges 100B are laminated in the Z directions and mounted in parallel. In this case, the liquid ejection device of the second embodiment may be configured as an inkjet printer that performs color printing. The configuration may be applied also to the liquid ejection device of the third embodiment, the fourth embodiment, and the fifth embodiment.

F3. Modification 3:

In the embodiments described above, the cartridge side fixation structure 220 has the heart cam groove structure. On the other hand, the cartridge side fixation structure 220 may not have the heart cam groove structure. For example, the cartridge side fixation structure 220 may have a configuration of only having a stepped part in which the projection portion 54*p* of the device side fixation structure 54 engages in the −Y direction, in the engagement state. In this case, it is desirable that the device side fixation structure 54 is configured so as to be able to be moved in the X directions by operation by the user, or the like, to release the engagement state.

F4. Modification 4:

In the embodiments described above, the first receiving part 150*a* and the second receiving part 150*b* are configured as hole parts inserted with corresponding positioning parts 53*a*, 53*b*, respectively. On the other hand, the first receiving part 150*a* and the second receiving part 150*b* may not be configured as hole parts, and, for example, may be formed as slits extending in the Z directions. In addition, the first receiving part 150*a* and the second receiving part 150*b* may be configured as contact parts with which the tip ends of the positioning parts 53*a*, 53*b* contact.

F5. Modification 5:

In the embodiments described above, the cartridge side electrical connection part 140 includes the substrate 141. On the other hand, the cartridge side electrical connection part 140 may not include the substrate 141. For example, the cartridge side electrical connection part 140 may have a configuration in which the device side electrical connection part 52 has only an electrode part with which the device side electrical connection part 52 electrically contacts. In the embodiments described above, the substrate par 141 of the cartridge side electrical connection part 140 is arranged so as to be directed diagonally upward. On the other hand, the substrate 141 of the cartridge side electrical connection part 140 may not be arranged so as to be directed diagonally upward. The substrate 141 only needs to be arranged in an angle so that the substrate 141 can electrically connect with the device side electrical connection part 52 in a state of receiving a force from the device side electrical connection part 52 at least to the +Z direction side. For example, the substrate 141 may be arranged substantially horizontally so as to be directed in the −Z direction.

F6. Modification 6:

The configuration of the cartridge 100 is not limited to the configuration described in the embodiments described above. For example, the case 101 of the cartridge 100 may have a substantially disc shape. In the connection receiving part 50, the liquid leading-out port 131 may not be located in the center in the X directions, and the cartridge side electrical connection part 140 may be provided in the center in the X directions. The liquid leading-out port 131 may not be provided between the pair of receiving parts 150*a*, 150*b* in the X directions. The pair of receiving parts 150*a*, 150*b* may not be provided in the same height position, and may have almost the same opening shape and opening size. The cartridge side electrical connection part 140 may not be formed in the deep position in the −Y direction side, and may not be formed in the position projecting in the +Y direction side. The configuration of the case 101 is not limited to the configuration described in the embodiments described above. The tray 102 of the case 101 may not be configured as a box body. For example, the tray 102 may be composed by a frame-shaped member in which a plurality of column-shaped members are combined. The lid member 103 described for the first embodiment may not be configured attachably and detachably, and may be configured to open and close. As described for the first embodiment, the case 101 may have a configuration in which the whole lid member 103 is omitted, and may have a configuration in which the lid member 103 blocks only a part of the opening part of the tray 102.

F7. Modification 7:

The connection receiving part 50 with which the cartridge 100 is connected is not limited to the configuration described for the embodiments described above. The connection receiving part 50 may not be configured as a single component, and may have a configuration in which the liquid leading-in part 51, the device side electrical connection part 52, and the pair of positioning parts 53*a*, 53*b* are independently and separately arranged as different members.

F8. Modification 8:

The configuration of the accommodation parts 110C, 110D (shown in FIG. 19, FIG. 20) described for the third embodiment and the fourth embodiment, instead of the accommodation parts 110*a*, 110*b* composed of the flexible bag-shaped member, may be applied to the first cartridge 100*a* and the second cartridge 100*b* of the first embodiment. In the cartridge 100 of the first embodiment described above, the accommodation part 110 is integrated to the case 101. On the other hand, in the cartridge 100, the accommodation part 110 may be configured so as to be attachably to and detachably from the case 101. In this case, the liquid may be replenished to the cartridge 100 by exchanging of the accommodation part 110. A configuration in which the liquid is replenished from the outside of the cartridge accommodation part 60 to a piping member such as a tube may be applied to the liquid ejection device of the embodiments.

F9. Modification 9:

The liquid ejection device 10 of the embodiments is a printer, and the liquid ejection system 11 is a printing system of an inkjet method. On the other hand, the liquid ejection device 10 may not be a printer, and the liquid ejection system 11 may not be a printing system. For example, the liquid ejection device 10 may be configured as a washing device that ejects a liquid detergent. In this case, the liquid ejection system is a washing system.

The present disclosure is not limited to the embodiments, examples, and modifications described above, and can be performed in various configurations without departing from the spirit of the disclosure. For example, the technical features in the embodiments, examples, and modification may be changed or combined as appropriate, in order to solve a part or all of the problem described above, or achieve a part or all of the effects described above. Technical features other than the features that are described in this specification as capable of being omitted can be deleted as appropriate, if the technical features are not described in this specification as essential.

What is claimed is:

1. A cartridge that is attachable to and detachable from a liquid ejection device having a cartridge accommodation part, when it is defined that a parallel direction to a gravity direction is a Z direction, the same direction as the gravity direction along the Z direction is a +Z direction, an opposite direction from the gravity direction along the Z direction is a −Z direction, an orthogonal direction to the Z direction is a Y direction, one direction of the Y direction is a +Y direction, the other direction of the Y direction is a −Y direction, an orthogonal direction to the Z direction and the Y direction is a X direction, one direction of the X direction is a +X direction, and the other direction of the X direction is a −X direction, the cartridge comprising:

a case configured to be inserted to the cartridge accommodation part by moving along the +Y direction;

an accommodation part provided in the inside of the case and configured to accommodate liquid;

a liquid leading-out port configured to accept a liquid leading-in part located in the end portion of the +Y direction side of the cartridge accommodation part, in a mounting state where the cartridge is mounted to the liquid ejection device;

a cartridge side electrical connection part configured to electrically contact with a device side electrical connection part located in the end portion of the +Y direction side of the cartridge accommodation part in the mounting state while receiving a force having a component of at least the +Z direction from the device side electrical connection part; and a cartridge side fixation structure configured to engage with a device side fixation structure located in the end portion of the +Y direction side of the cartridge accommodation part, in the mounting state, wherein the case is restricted moving in the −Y direction in a state of being imparted with the force directing in the −Z direction by engagement of the device side fixation structure and the cartridge side fixation structure in the mounting state, the cartridge side fixation structure and the cartridge side electrical connection part are provided at a position where they overlap with each other at least in a part when the cartridge in a posture of the mounting state is viewed in the Z direction, and in the posture of the mounting state, a width of the cartridge in the Z direction is smaller than a width of the cartridge in the Y direction and a width of the cartridge in the X direction.

2. The cartridge in accordance with claim 1, wherein the cartridge side electrical connection part has a contact surface that contacts with the device side electrical connection part in the mounting state, and a normal vector of the contact surface has a vector component of the −Z direction and a vector component of the +Y direction when the cartridge is in the posture of the mounting state.

3. The cartridge in accordance with claim 1, wherein the liquid ejection device includes a first positioning part and a second positioning part that extend from the end portion of the +Y direction side of the cartridge accommodation part to the −Y direction side, and are provided in positions that are spaced from each other sandwiching the liquid leading-in part in the X direction, and the case includes a first receiving part that receives the first positioning part, and a second receiving part that receives the second positioning part, in the mounting state.

4. The cartridge in accordance with claim 3, wherein at the time of the posture of the mounting state, the first receiving part is located in the −X direction side with respect to the liquid leading-out port, and the second receiving part is located in the +X direction side with respect to the liquid leading-out port.

5. The cartridge in accordance with claim 4, wherein in the posture of the mounting state, the cartridge side electrical connection part and the cartridge side fixation structure are located in between the liquid leading-out port and the first receiving part in the X direction.

6. The cartridge in accordance with claim 3, wherein the first receiving part has a first opening part in which the first positioning part is inserted, the second receiving part has a second opening part in which the second positioning part is inserted, and in the posture of the mounting state, an opening width of the second opening part in the X direction is larger than an opening width of the first opening part in the X direction.

7. A liquid ejection system comprising a liquid ejection device, and a cartridge, when it is defined that a parallel direction to a gravity direction is a Z direction, the same direction as the gravity direction along the Z direction is a +Z direction, the opposite direction from the gravity direction along the Z direction is a −Z direction, an orthogonal direction to the Z direction is a Y direction, one direction of the Y direction is a +Y direction, the other direction of the Y direction is a −Y direction, an orthogonal direction to the Z direction and the Y direction is a X direction, one direction of the X direction is a +X direction, and the other direction of the X direction is a −X direction, the liquid ejection device including:

a housing provided with a cartridge accommodation part in the inside, a device side fixation structure that extends from the end portion of the +Y direction side of the cartridge accommodation part to the −Y direction side, a liquid leading-in part located in the end portion of the +Y direction side of the cartridge accommodation part, and a device side electrical connection part located in the end portion of the +Y direction side of the cartridge accommodation part, the cartridge being configured so as to be attachable to and detachable from the liquid ejection device, the cartridge including:

a case configured to be inserted to the cartridge accommodation part by moving along the +Y direction, an accommodation part provided in the inside of the case and configured to accommodate liquid, a liquid leading-out port configured to accept the liquid leading-in part in a mounting state where the cartridge is mounted to the liquid ejection device, a cartridge side electrical connection part configured to electrically contact with the device side electrical connection part while receiving a force having a component of at least the +Z direction, from the device side electrical connection part in the mounting state, and a cartridge side fixation structure configured to engage with the device side fixation structure in the mounting state, wherein the case is restricted moving in the −Y direction in a state of being imparted with the force directing in the −Z direction by engagement of the device side fixation structure and the cartridge side fixation structure in the mounting state, the cartridge side fixation structure and the cartridge side electrical connection part are provided at a position where they overlap with each other at least in a part when the cartridge in a posture of the mounting state is viewed in the Z direction, in the posture of the mounting state, a width of the cartridge in the Z direction is smaller than a width of the cartridge in the Y direction and a width of the cartridge in the X direction.

8. The liquid ejection system in accordance with claim 7, wherein the cartridge side electrical connection part has a contact surface that contacts with the device side electrical connection part in the mounting state, and a normal vector of the contact surface has a vector component of the −Z direction and the vector component of the +Y direction when the cartridge is in the posture of the mounting state.

9. The liquid ejection system in accordance with claim 7, wherein the liquid ejection device includes a first positioning part and a second positioning part that extend from the end portion of the +Y direction side of the cartridge accommodation part to the −Y direction side, and are provided in positions that are spaced from each other sandwiching the liquid leading-in part in the X direction, and the cartridge includes a first receiving part that receives the first positioning part, and a second receiving part that receives the second positioning part, in the mounting state.

10. The liquid ejection system in accordance with claim 9, wherein when the cartridge is in the posture of the mounting state, the first receiving part is located in the −X direction side with respect to the liquid leading-out port, and the second receiving part is located in the +X direction side with respect to the liquid leading-out port.

11. The liquid ejection system in accordance with claim 10, wherein when the cartridge is in the posture of the mounting state, the cartridge side electrical connection part and the cartridge side fixation structure are located in between the liquid leading-out port and the first receiving part in the X direction.

12. The liquid ejection system in accordance with claim 9, wherein the first receiving part has a first opening part in which the first positioning part is inserted, the second receiving part has a second opening part in which the second positioning part is inserted, and in the posture of the cartridge in the mounting state, an opening width of the second opening part in the X direction is larger than an opening width of the first opening part in the X direction.

13. The liquid ejection system in accordance with claim 9, wherein, the device side fixation structure and the cartridge side fixation structure be configured so that, when being in an engagement state where the device side fixation structure and the cartridge side fixation structure engage with each other, the case is pushed in the +Y direction to release the engagement state to allow movement of the case in the −Y direction.

* * * * *